US007737908B2

(12) United States Patent
Yanagi et al.

(10) Patent No.: US 7,737,908 B2
(45) Date of Patent: Jun. 15, 2010

(54) ANTENNA APPARATUS

(75) Inventors: Masahiro Yanagi, Shinagawa (JP); Shigemi Kurashima, Shinagawa (JP); Hideki Iwata, Shinagawa (JP); Takashi Yuba, Shinagawa (JP); Masahiro Kaneko, Shinagawa (JP); Yuriko Segawa, Shinagawa (JP); Takashi Arita, Shinagawa (JP); Toshihiro Kusagaya, Shinagawa (JP); Kazuhiko Ikeda, Iiyama (JP); Hiroshi Matsumiya, Iiyama (JP); Kazuo Nomura, Iiyama (JP)

(73) Assignee: Fujitsu Component Limited, Tokyo (JP)

( * ) Notice: Subject to any disclaimer, the term of this patent is extended or adjusted under 35 U.S.C. 154(b) by 335 days.

(21) Appl. No.: 11/581,376

(22) Filed: Oct. 17, 2006

(65) Prior Publication Data

US 2007/0229360 A1 Oct. 4, 2007

(30) Foreign Application Priority Data

Mar. 30, 2006 (JP) ..... 2006-094429
Sep. 6, 2006 (JP) ..... 2006-242016

(51) Int. Cl.
*H01Q 1/40* (2006.01)

(52) U.S. Cl. ..... 343/846; 343/700 MS; 343/873

(58) Field of Classification Search ..... 343/700 MS, 343/829, 830, 846, 872, 873
See application file for complete search history.

(56) References Cited

U.S. PATENT DOCUMENTS

| | | | | | |
|---|---|---|---|---|---|
| 4,170,013 | A | * | 10/1979 | Black | 343/700 MS |
| 4,661,821 | A | * | 4/1987 | Smith | 343/743 |
| 4,700,194 | A | * | 10/1987 | Ogawa et al. | 343/700 MS |
| 5,913,174 | A | * | 6/1999 | Casarez et al. | 455/557 |
| 6,037,912 | A | * | 3/2000 | DeMarre | 343/815 |
| 6,313,798 | B1 | * | 11/2001 | Bancroft et al. | 343/700 MS |
| 2005/0285805 | A1 | * | 12/2005 | Ikeda et al. | 343/713 |
| 2008/0055183 | A1 | * | 3/2008 | Yuba et al. | 343/872 |

FOREIGN PATENT DOCUMENTS

JP 2000-196327 7/2000

OTHER PUBLICATIONS

Takuya Taniguchi et al., "An Omnidirectional and Low-VSWR Antenna for the FCC-Approved UWB Frequency Band", *The Institute of Electronics, Information and Communication Engineers*, B-1-133, 2003.

* cited by examiner

*Primary Examiner*—Tho G Phan
(74) *Attorney, Agent, or Firm*—Staas & Halsey LLP

(57) ABSTRACT

A disclosed antenna apparatus includes: a punched out antenna element made of a sheet metal; a punched out ground element made of a sheet metal, the ground element facing the antenna element; and a surface mount type coaxial connector mounted across the antenna element and the ground element.

3 Claims, 27 Drawing Sheets

ANTENNA APPARATUS

BACKGROUND OF THE INVENTION

1. Field of the Invention

The present invention generally relates to an antenna apparatus and a manufacturing method thereof, and particularly to a flat antenna apparatus using UWB (ultra-wide band) and a manufacturing method thereof.

2. Description of the Related Art

In recent years, radio communication technologies using UWB have attracted attention due to capability of radar positioning and communication with large capacity of transmission. Regarding the UWB, the FCC (federal communication commission) in the United States allowed the use of frequency bandwidth from 3.1 to 10.6 GHz in 2002.

The UWB is a communication method in which pulse signals are used in an ultra-wide band. Thus, an antenna used for the UWB is required to have a structure enabling transmission and reception of in the ultra-wide band.

An antenna made of a base board and a power feeder has been proposed as an antenna used in a bandwidth from 3.1 to 10.6 GHz allowed by the FCC (Non-patent Document 1)

FIGS. 1A and 1B show conventional antenna apparatuses. An antenna apparatus 10 shown in FIG. 1A includes a base board 11 and a power feeder 12 disposed thereon, the power feeder 12 having an inverted conical shape. The cone constituting the power feeder 12 is set such that a side face thereof forms an angle θ relative to an axis. In accordance with the angle θ, it is possible to obtain desired capability characteristics.

An antenna apparatus 20 shown in FIG. 1B includes the base board 11 and a teardrop-shaped power feeder 22 disposed thereon, the power feeder 22 being made of a cone 22*a* and a sphere 22*b* inscribed therein.

Non-patent Document 1: "An omnidirectional and low-VSWR antenna for the FCC-approved UWB frequency band" Takuya Taniguchi and Takehiko Kobayashi (Tokyo Denki University), The Institute of Electronics, Information and Communication Engineers, B-1-133, 2003, (presented on March 22, at room B201)

Patent Document 1: Japanese Laid-Open Patent Application No. 2000-196327

Conventional wide-band antenna apparatuses include a tabular base board and a power feeder having a conical or teardrop shape disposed thereon, so that such apparatuses are large in size and thin type antenna apparatuses have been desired.

FIGS. 2A and 2B show a UWB flat antenna apparatus 30 disclosed in the specification and the drawings of Japanese Patent Application No. 2006-91602 previously submitted by the inventors of the present invention. The UWB flat antenna apparatus 30 includes a dielectric base 31 having a top face 31*a*, on which an antenna element pattern 32, a strip line 33, and two ground patterns 34 and 35 are disposed, and a coaxial connector 50 mounted on an end of the base 31. In accordance with this, the apparatus is made to be smaller and thinner in comparison with conventional antenna apparatuses.

The strip line 33, the two ground patterns 34 and 35 on both sides of the strip line 33, and the base 31 constitute a coplanar microwave transmission line 40. The coaxial connector 50 is soldered and fixed to the strip line 33 and the ground patterns 34 and 35 at a terminal end of the coplanar microwave transmission line 40 extending from the antenna element pattern 32.

The UWB flat antenna apparatus 30 requires the dielectric base 31 and requires deposition steps and etching steps in order to form the antenna element pattern 32, the strip line 33, and the two ground patterns 34 and 35. Further, both deposition steps and etching steps require man-hours, so that it is difficult to reduce manufacturing costs thereof.

SUMMARY OF THE INVENTION

It is a general object of the present invention to provide an improved and useful antenna apparatus and a manufacturing method thereof in which the above-mentioned problems are eliminated.

A more specific object of the present invention is to provide an antenna apparatus and a manufacturing method thereof that can reduce the manufacturing costs thereof.

According to the present invention there is provided an antenna apparatus comprising: a punched out antenna element made of a sheet metal; a punched out ground element made of a sheet metal, the ground element facing the antenna element; and a surface mount type coaxial connector mounted across the antenna element and the ground element.

Both antenna element and ground element are prepared by punching out from a sheet metal, so that neither time-consuming deposition steps nor etching steps are required. Thus, it is possible to reduce manufacturing costs.

Further, a dielectric base is not necessary, so that it is possible to reduce manufacturing costs in this respect.

Other objects, features and advantage of the present invention will become more apparent from the following detailed description when read in conjunction with the accompanying drawings.

BRIEF DESCRIPTION OF THE DRAWINGS

FIG. 8 is a diagram showing an antenna with link bars;

DETAILED DESCRIPTION OF THE PREFERRED EMBODIMENTS

In the following, embodiments of the present invention will be described with reference to the accompanying drawings.

EXAMPLE 1

Figure 3:
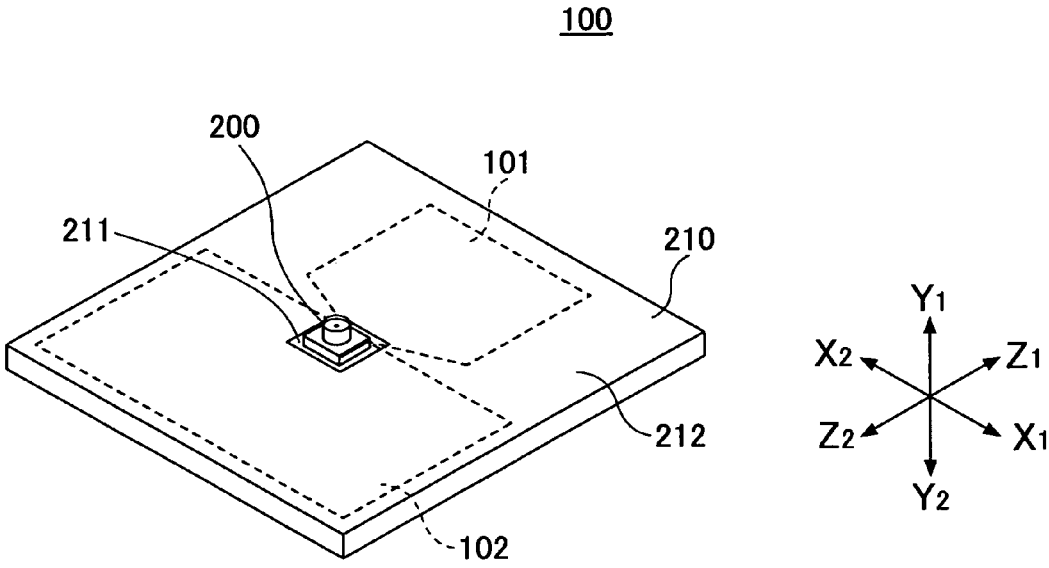
FIG. 3 is a perspective view showing a UWB flat antenna apparatus according to example 1 of the present invention.
Figure 4A:
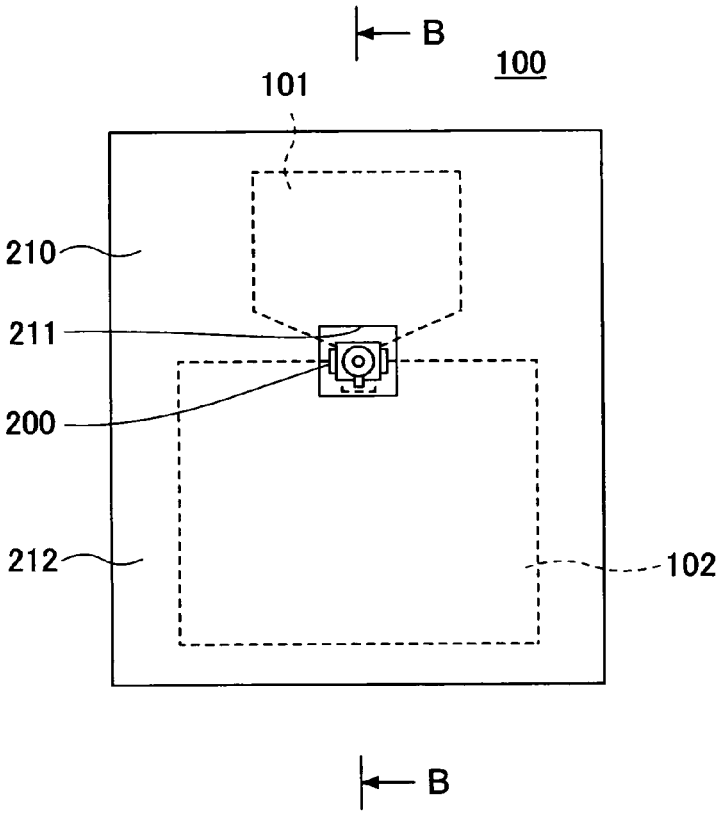
FIG. 4A is a plan view showing the UWB flat antenna apparatus in FIG. 3.
Figure 4B:
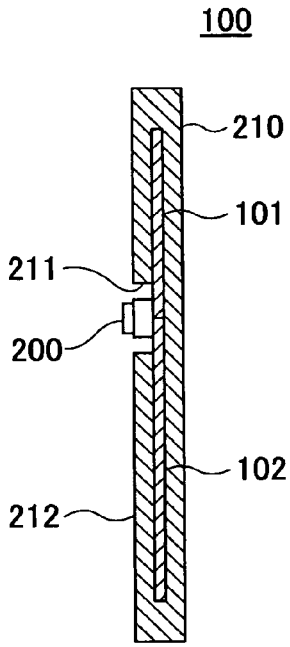
FIG. 4B is a cross-sectional view of the UWB flat antenna apparatus taken along line B-B in FIG. 4A.

FIGS. 3, 4A, and 4B show a UWB flat antenna apparatus 100 according to example 1 of the present invention.

The antenna apparatus 100 includes an antenna element 101 made of a copper plate and a ground element 102 also made of a copper plate, a socket-type coaxial connector 200 of a surface mount type, and a synthetic resin portion 210 such as ABS covering the antenna element 101 and the ground element 102.

The antenna element 101 is manufactured by punching out from a copper plate using a press. The antenna element 101 has a home plate-like shape and an opening angle θ at a protrusion (feeding point) 101*a* is about 60 degrees (refer to FIG. 8).

The ground element 102 is manufactured by punching out from a copper plate using a press. The ground element 102 has a quadrangular shape and a concave portion 102*a* (refer to FIG. 8).

The antenna element 101 and the ground element 102 are manufactured at once by punching out from a copper plate using a press.

Figure 5A:
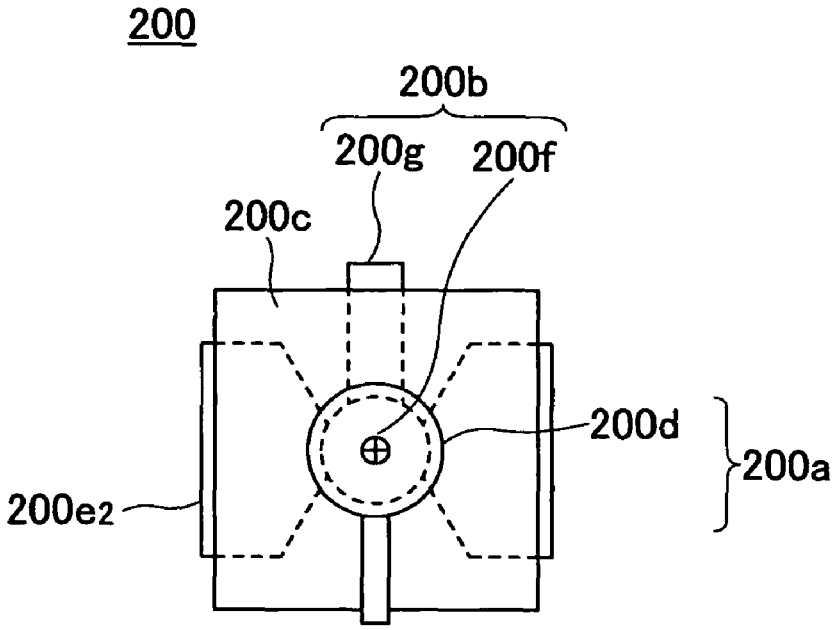
FIG. 5A is a plan view showing a socket-type coaxial connector.
Figure 5B:
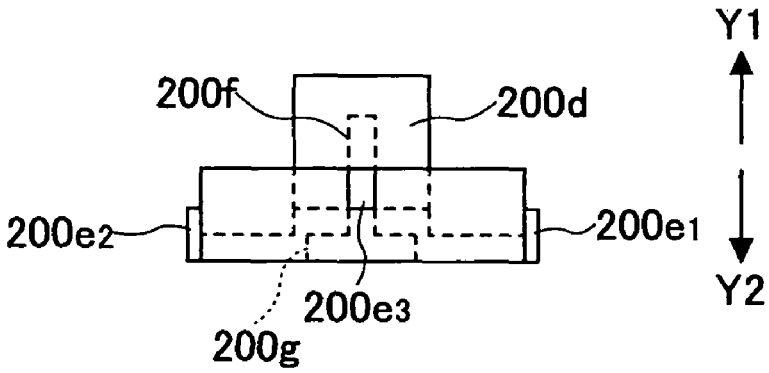
FIG. 5B is a side view showing a socket-type coaxial connector.
Figure 5C:
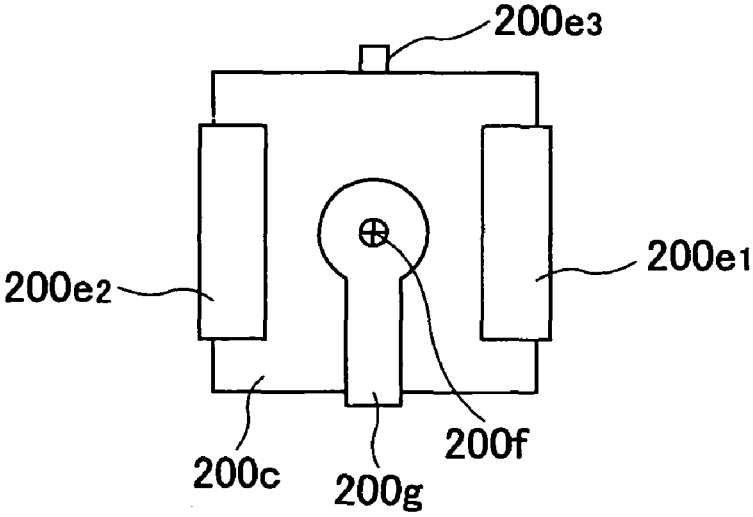
FIG. 5C is a plan view showing a socket-type coaxial connector.

As shown in FIGS. 5A, 5B, and 5C, the socket-type coaxial connector 200 is of a surface mount type. The socket-type coaxial connector 200 is molded including a shield portion 200*a* and a signal line connecting portion 200*b* in an integrated manner using an insulation portion 200*c*.

The shield portion 200*a* is made of a conductive material and includes a connecting portion 200*d* and contact portions 200*e*1, 200*e*2, and 200*e*3. The connecting portion 200*d* has a substantially cylindrical shape, extends in a Y1 direction indicated by an arrow, and is engaged with the shield of the plug connector. The contact portions 200*e*1, 200*e*2, and 200*e*3 are connected to the connecting portion 200*d* and exposed at a bottom of an insulation portion 200*c* in a Y2 direction indicated by an arrow.

The signal line connecting portion 200*b* is made of a conductive material and includes a connection pin 200*f* and a contact portion 200*g*. The connection pin 200*f* as a central conductor extends from the insulation portion 200*c* to an inner periphery of the connecting portion 200*d* in the Y1 direction and is connected to a signal line of the plug connector when the plug connector is mounted. The contact portion 200*g* is connected to the central conductor 200*f* and exposed at the bottom of the insulation portion 200*c* in the Y2 direction indicated by the arrow.

The antenna element 101 and the ground element 102 are in co-planar relationship and disposed closely such that the protrusion 101*a* is spaced by a gap from, and faces, the concave portion 102*a*. The socket-type coaxial connector 200 is mounted at respective positions on the protrusion 101*a* and on the concave portion 102*a* such that the socket-type coaxial connector 200 is disposed across (i.e., spanning the gap between, and interconnecting) the antenna element 101 and the ground element 102. The contact portion 200*g* is soldered to the protrusion 101*a* of the antenna element 101 and the contact portions 200*e*1 and 200*e*2 are soldered to portions of the concave portion 102*a* of the ground element 102.

The synthetic resin portion 210 is formed by insert molding such that an antenna body 140, described later, is wrapped therein. The synthetic resin portion 210 covers the antenna element 101 and the ground element 102 except a position of the socket-type coaxial connector 200 and has a plate-like shape. The socket-type coaxial connector 200 is exposed from a window portion 211 of a top face 212 of the synthetic resin portion 210.

The UWB flat antenna apparatus 100 is used in a frequency bandwidth of 3 to 6 GHz. In practice, the antenna apparatus 100 is used when a coaxial connector at an end of a coaxial cable (neither is shown in the drawings) extending from a device is connected to the socket-type coaxial connector 200. High-frequency signals are supplied to the antenna element 101, the ground element 102 is for ground potential, and electric lines of force are formed between the antenna element 101 and the ground element 102.

In addition, in terms of function, the antenna apparatus 100 functions as a UWB flat antenna apparatus without the synthetic resin portion 210, namely, using the antenna element 101, the ground element 102, and the socket-type coaxial connector 200.

In the following, a method for manufacturing the UWB flat antenna apparatus 100 is described.

The UWB flat antenna apparatus 100 is manufactured without time-consuming deposition steps and etching steps.

Figure 6:
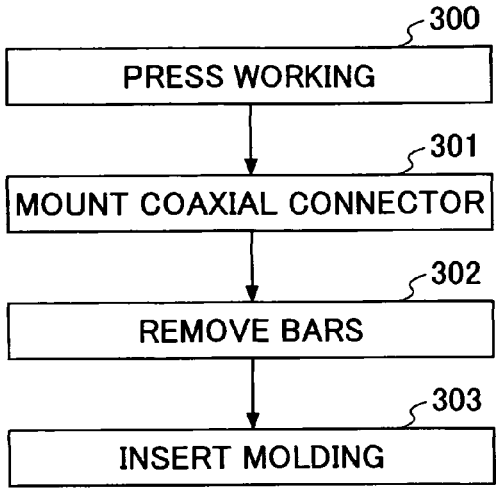
FIG. 6 is a diagram showing steps for manufacturing the UWB flat antenna apparatus in FIG. 3.

As shown in FIG. 6, the UWB flat antenna apparatus 100 is manufactured through a step 300 of press working, a step 301 of mounting the socket-type coaxial connector 200, a step 302 of removing link bars, and a step 303 of insert molding.

[Step 300 of Press Working]

Figure 7:
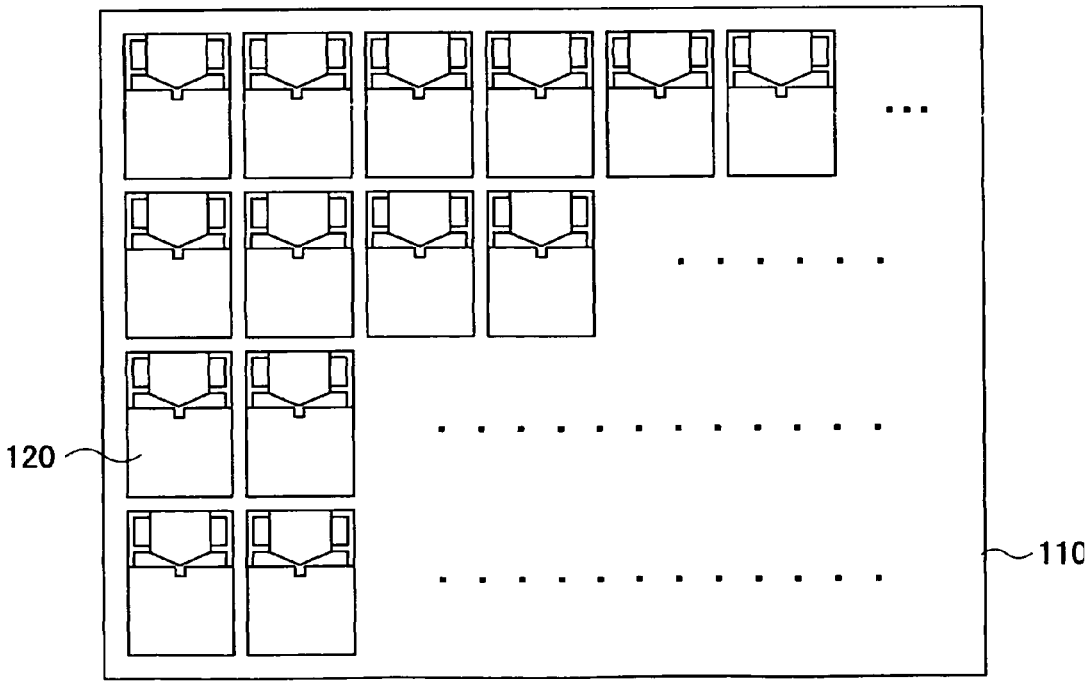
FIG. 7 is a diagram illustrating a step of press working in FIG. 6.

As shown in FIG. 7, multiple antennas 120 with link bars are punched out by pressing a copper plate 110.

FIG. 8 is a diagram showing a single antenna 120 with link bars. In the antenna 120 with link bars, the antenna element 101 and the ground element 102 are linked by F-shaped link bars 121 and 122. Due to the F-shaped link bars 121 and 122, the antenna element 101 and the ground element 102 are brought close to each other and maintained in a relationship such that the protrusion 101*a* and the concave portion 102*a* are positioned in an opposing manner.

In addition, boundaries between the link bars 121 and 122 and the antenna element 101 and boundaries between the link bars 121 and 122 and the ground element 102 are made to be half-cut portions 123.

[Step 301 of Mounting Socket-type Coaxial Connector 200]

Figure 9:
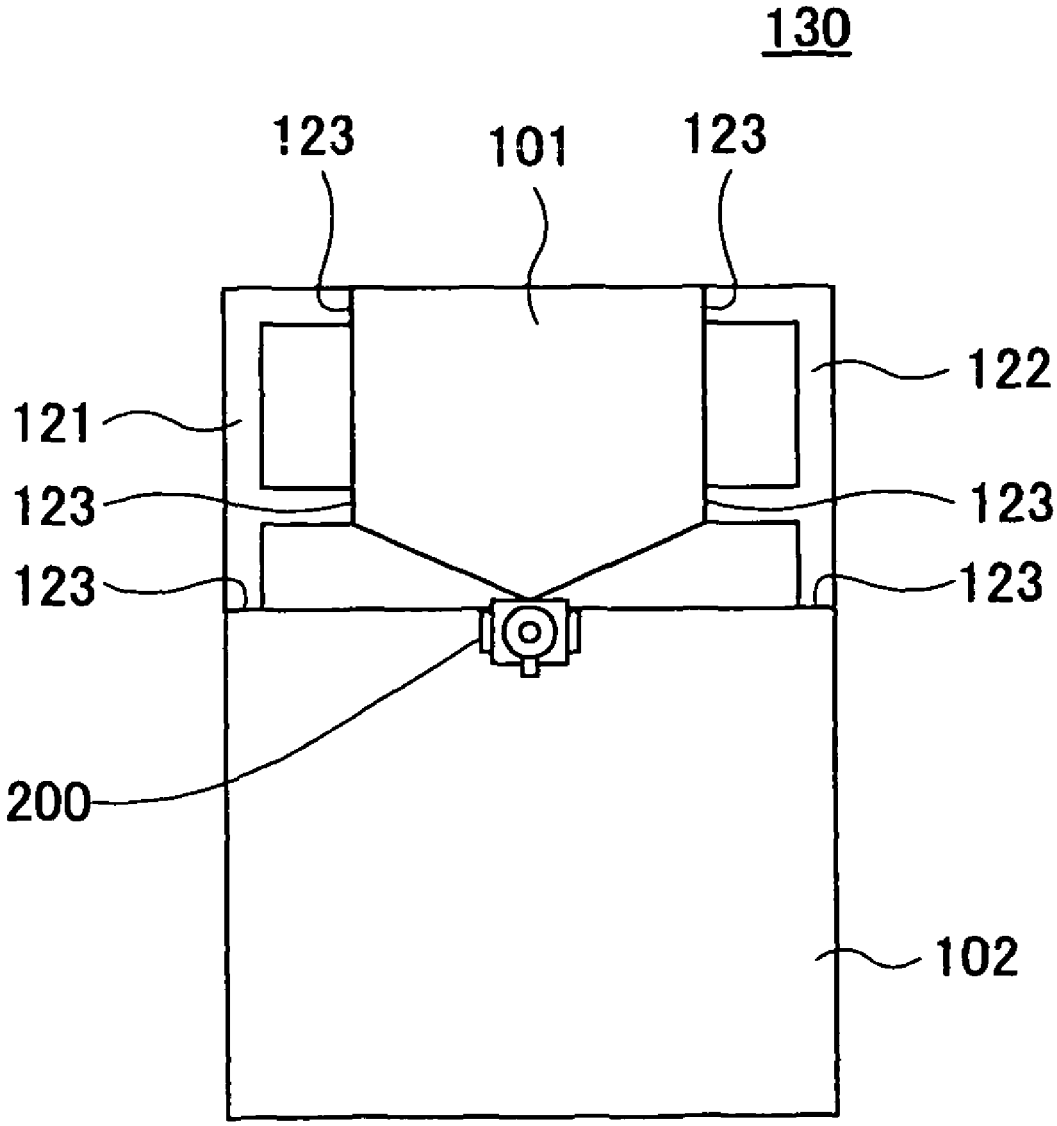
FIG. 9 is a diagram showing an antenna with link bars on which a socket-type coaxial connector is mounted.

The socket-type coaxial connector 200 is mounted at the positions of the protrusion 101*a* and the concave portion 102*a* such that the socket-type coaxial connector 200 is disposed across the antenna element 101 and the ground element 102. In accordance with this, it is possible to obtain an antenna 130 with link bars on which a socket-type coaxial connector is mounted as shown in FIG. 9

[Step 302 of Removing Link Bars]

Figure 10:
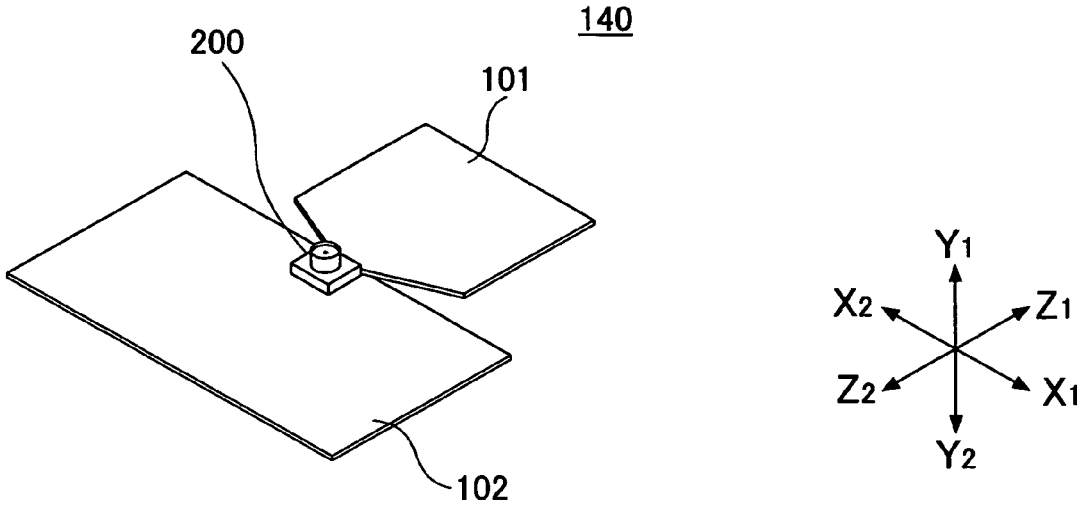
FIG. 10 is a perspective view showing an antenna body.

The antenna body 140 as shown in FIG. 10 is obtained from the antenna 130 with link bars on which a socket-type coaxial connector is mounted, by removing the link bars 121 and 122.

The removal of the link bars 121 and 122 is readily made due to the presence of the half-cut portions 123. In other words, by bending the link bars 121 and 122 relative to the antenna element 101 and the ground element 102, the half-cut portions 123 are readily cut and the link bars 121 and 122 are easily removed.

When the link bars 121 and 122 are removed, as shown in FIG. 10, the antenna element 101 and the ground element 102 are linked by the socket-type coaxial connector 200. This is referred to as the antenna body 140.

[Step 303 of Performing Insert Molding]

Figure 11:
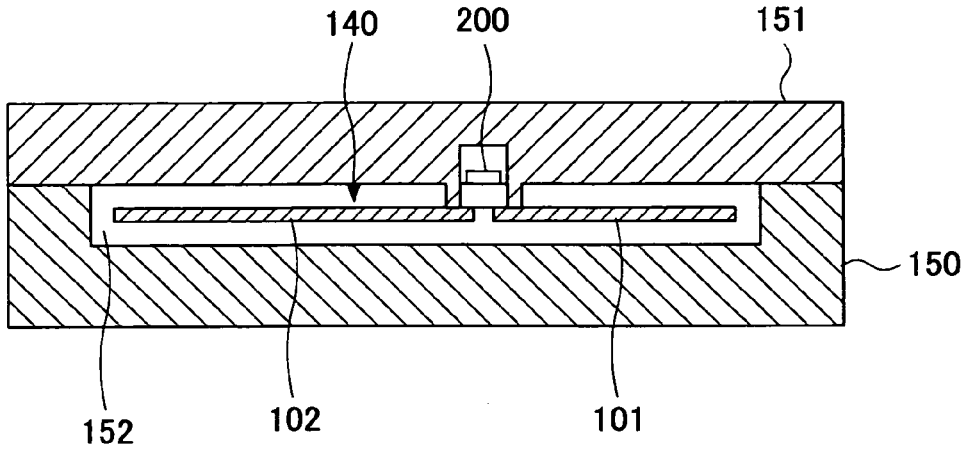
FIG. 11 is a diagram illustrating a step of insert molding.

The antenna body 140 shown in FIG. 10 is set in metal molds 150 and 151 with the socket-type coaxial connector 200 being exposed as shown in FIG. 11 and ABS resin is injected into a cavity 152.

In accordance with this, the plate-like synthetic resin portion 210 shown in FIG. 3 is formed, the antenna element 101 and the ground element 102 are wrapped and fixed in the synthetic resin portion 210, thereby completing the manufacture of the UWB flat antenna apparatus 100 in which the socket-type coaxial connector 200 is exposed from the window portion 211.

Figure 1A:
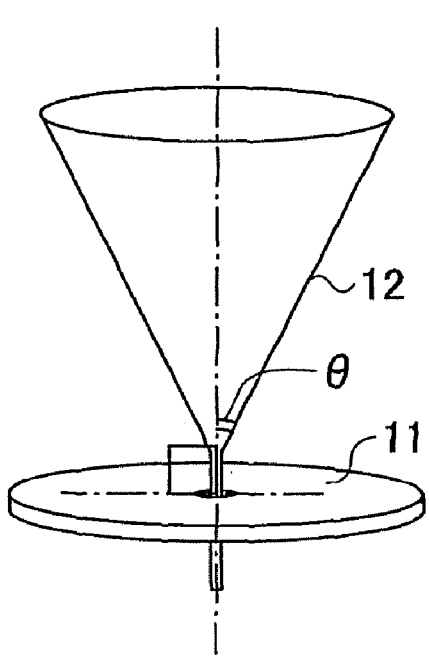
Prior Art FIG.1A
FIG. 1A is a configuration diagram as an example of a conventional antenna apparatus.
Figure 1B:
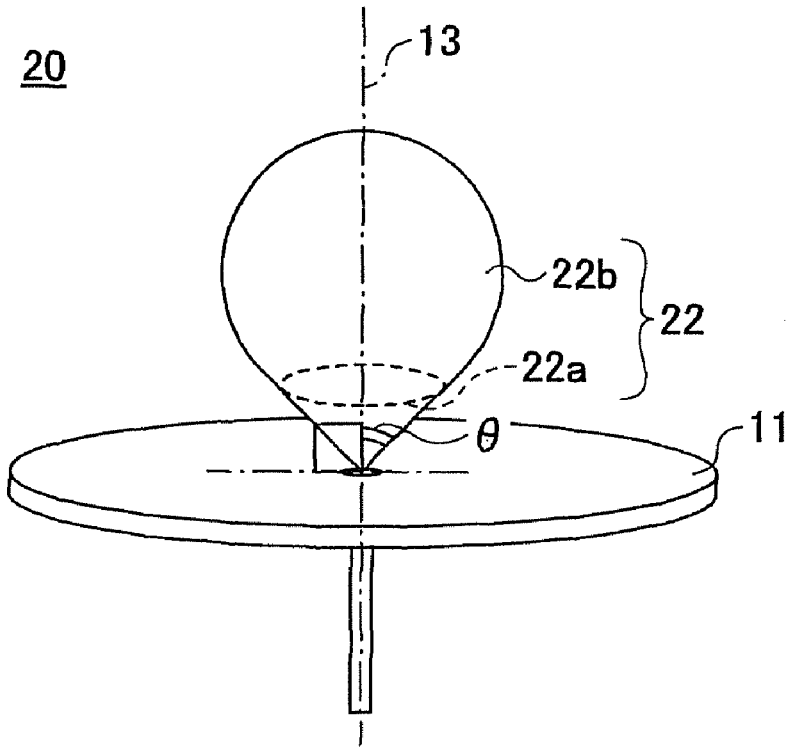
Prior Art FIG.1B
FIG. 1B is a configuration diagram as another example of a conventional antenna apparatus.
Figure 2A:
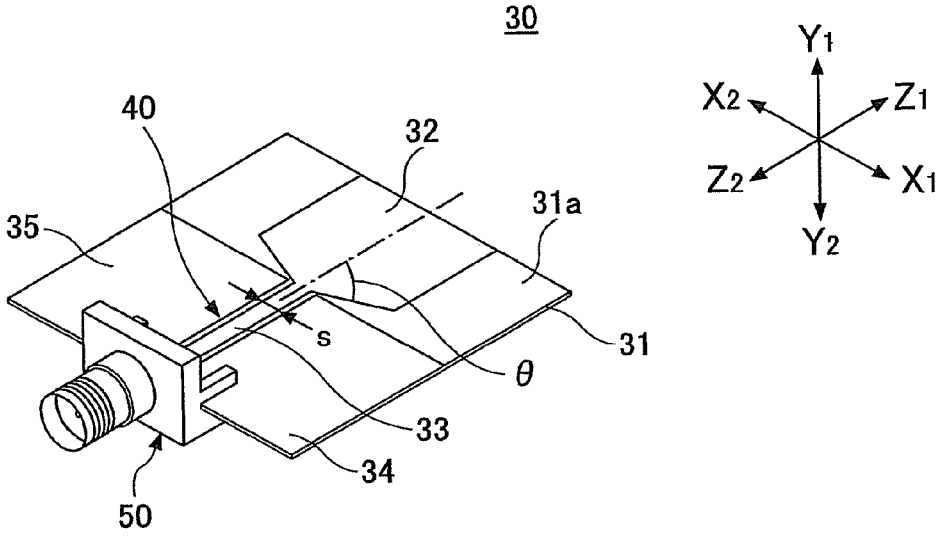
Prior Art FIG.2A
FIG. 2A is a perspective view showing a configuration of a UWB flat antenna apparatus previously applied by the applicants of the present invention.
Figure 2B:
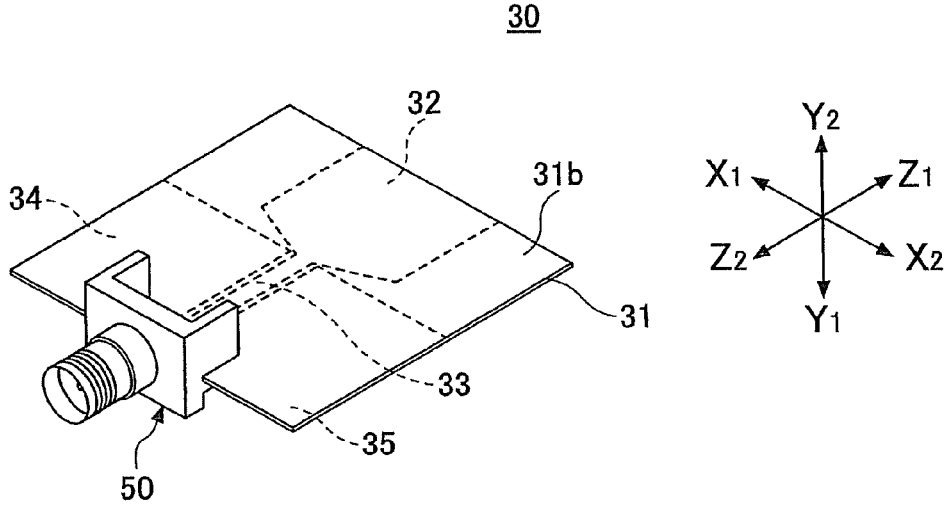
Prior Art FIG.2B
FIG. 2B is another perspective view showing a configuration of a UWB flat antenna apparatus previously applied by the applicants of the present invention.

As mentioned above, the manufacture of the UWB flat antenna apparatus 100 requires neither time-consuming deposition steps nor etching steps. Thus, it is possible to manufacture the UWB flat antenna apparatus 100 at a lower cost in comparison with the UWB flat antenna apparatus 30 shown in FIG. 2.

EXAMPLE 2

Figure 12:
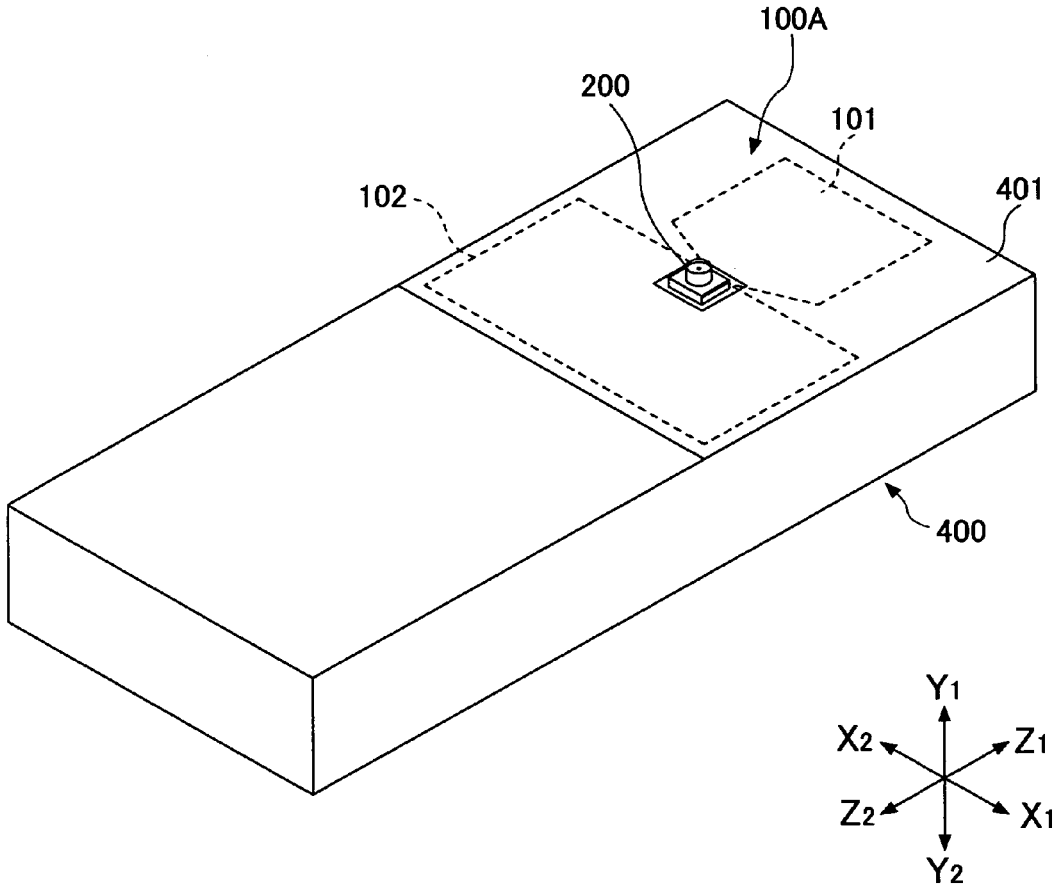
FIG. 12 is a perspective view showing a UWB flat antenna apparatus according to example 2 of the present invention.

FIG. 12 shows a UWB flat antenna apparatus 100A according to example 2 of the present invention. The UWB flat antenna apparatus 100A includes the antenna body 140 of FIG. 10 inserted into a molded case of an electronic device 400.

The electronic device 400 of this structure does not need to have a thin space or the like for mounting the antenna body 140, so that it is possible to construct the electronic device 400 as a smaller device.

EXAMPLE 3

Figure 13:
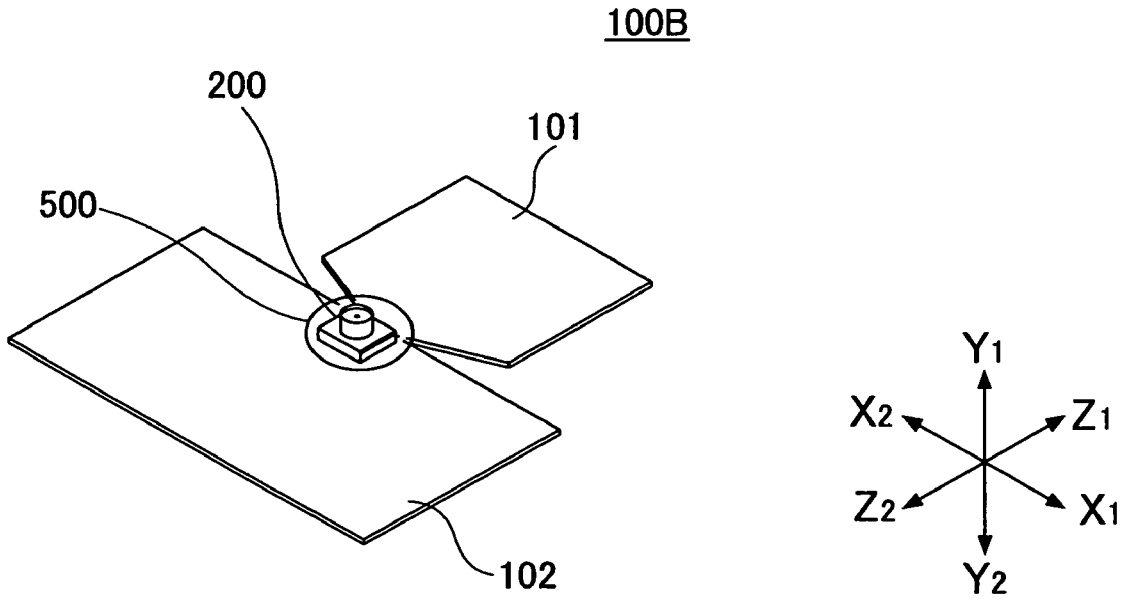
FIG. 13 is a perspective view showing a UWB flat antenna apparatus according to example 3 of the present invention.
Figure 14:
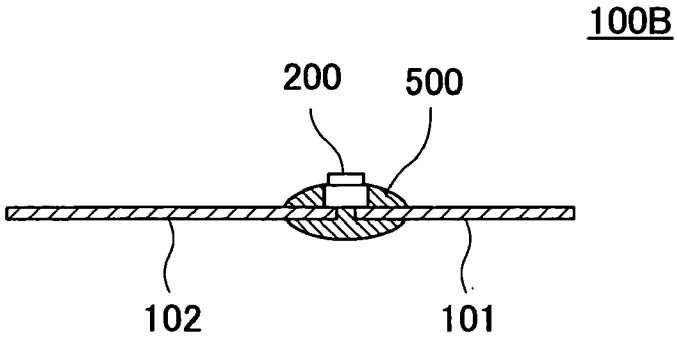
FIG. 14 is a side view showing the UWB flat antenna apparatus in FIG. 13.

FIGS. 13 and 14 show a UWB flat antenna apparatus 100B according to example 3 of the present invention. The UWB flat antenna apparatus 100B includes the antenna body 140 of FIG. 10 and a synthetic resin portion 500 formed limitedly on the periphery of the socket-type coaxial connector 200. The synthetic resin portion 500 covers the periphery of the socket-type coaxial connector 200 of the antenna element 101 and the ground element 102. The synthetic resin portion 500 fixes the antenna element 101 and the ground element 102. Large portions of the antenna element 101 and the ground element 102 are exposed.

Figure 15:
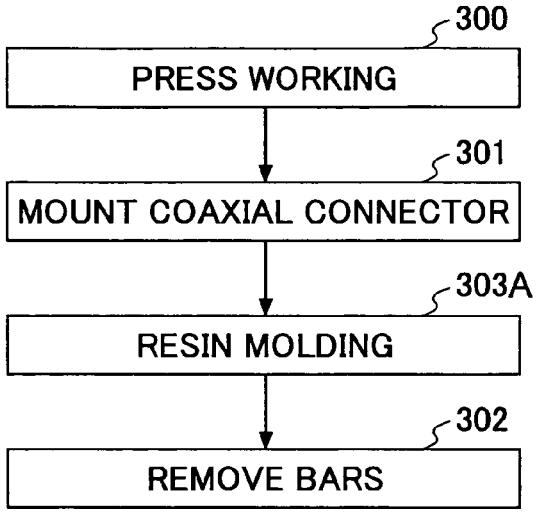
FIG. 15 is a diagram showing steps for manufacturing the UWB flat antenna apparatus in FIG. 13.

As shown in FIG. 15, the UWB flat antenna apparatus 100B is manufactured through the step 300 of press working, the step 301 of mounting the socket-type coaxial connector 200, a step 303A of performing resin molding, and the step 302 of removing link bars.

Figure 16:
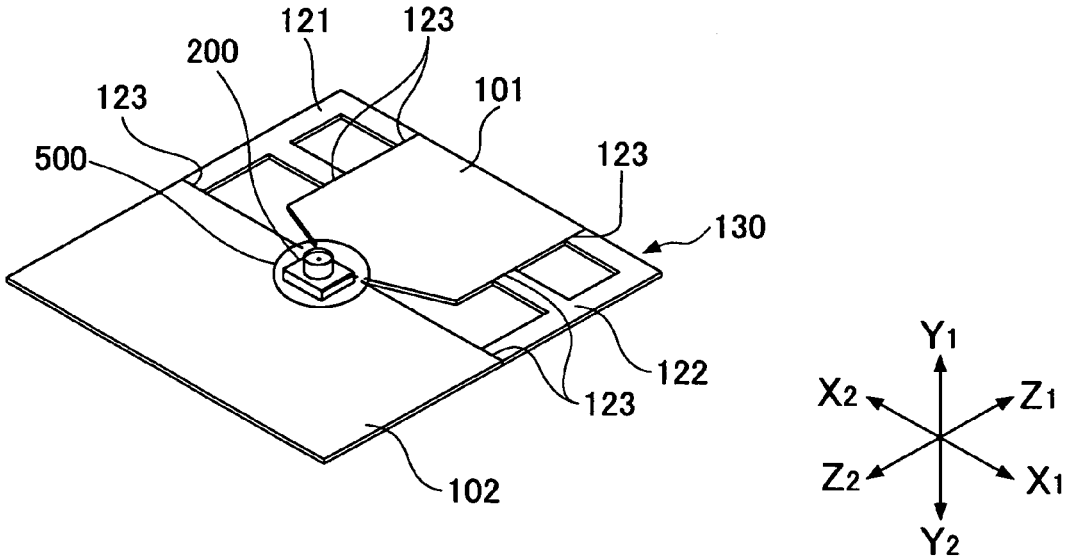
FIG. 16 is a diagram showing when a resin molding step in FIG. 15 is completed.

FIG. 16 shows when the resin molding step 303A is completed. The antenna 130 with link bars on which a socket-type coaxial connector is mounted as shown in FIG. 9 is set in a mold and the synthetic resin portion 500 is limitedly formed on the periphery of the socket-type coaxial connector 200.

When the antenna element 101 is firmly connected to the ground element 102 by the synthetic resin portion 500 in this manner, the link bars 121 and 122 are removed. Thus, the step of removing link bars is stably performed without a possibility of changing the relative position of the antenna element 101 and the ground element 102.

EXAMPLE 4

Figure 17:
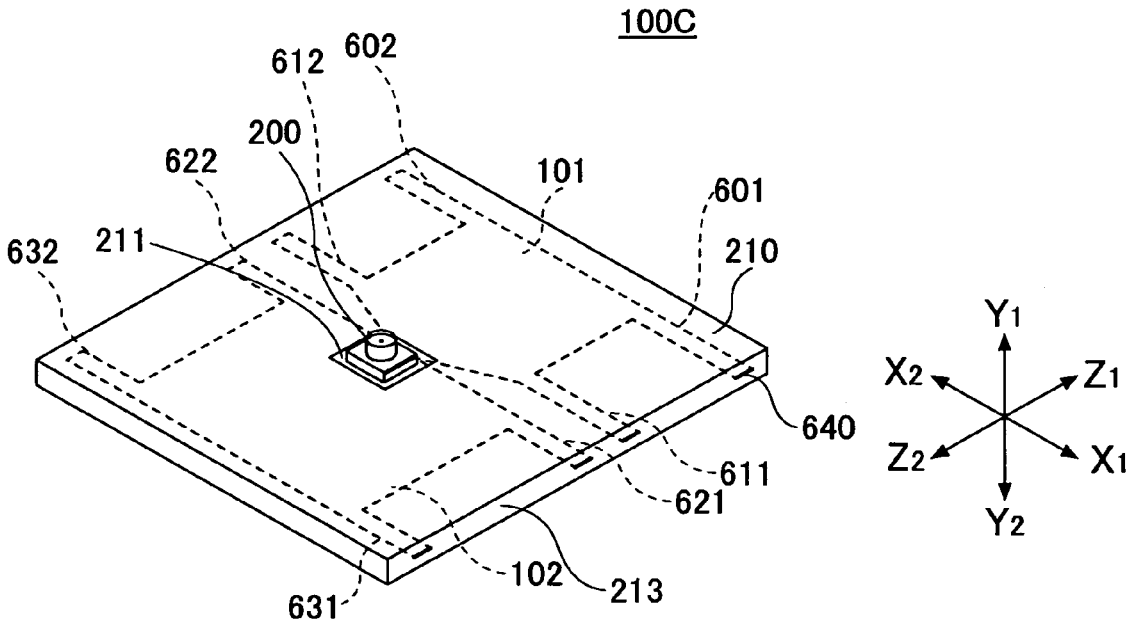
FIG. 17 is a perspective view showing a UWB flat antenna apparatus according to example 4 of the present invention.

FIG. 17 shows a UWB flat antenna apparatus 100C according to example 4 of the present invention.

The UWB flat antenna apparatus 100C is different from the UWB flat antenna apparatus 100 shown in FIG. 3 in that the antenna element 101 has rungs 601, 602, 611, and 612 on both sides thereof, the rungs extending to side faces of the UWB flat antenna apparatus 100C, and the ground element 102 has rungs 621, 622, 631, and 632 on both sides thereof, the rungs extending to the side faces of the UWB flat antenna apparatus 100C. Other structure is the same as the structure of the UWB flat antenna apparatus 100. These rungs extend in X1-X2 directions. In the UWB flat antenna apparatus 100C, the antenna element 101 and the ground element 102 both made of a copper plate are positioned closely to each other, the socket-type coaxial connector 200 is mounted across the antenna element 101 and the ground element 102, and the plate-like synthetic resin portion 210 covers the antenna element 101 and the ground element 102. Numeral 640 designates an end of the rung 601, for example, and the end of the rung 601 is exposed on the side face of the UWB flat antenna apparatus 100, namely, on a side face 213 of the synthetic resin portion 210.

In the following, first, second, and third method for manufacturing the above-mentioned UWB flat antenna apparatus 100C are described.

(First Manufacturing Method)

Figure 18:
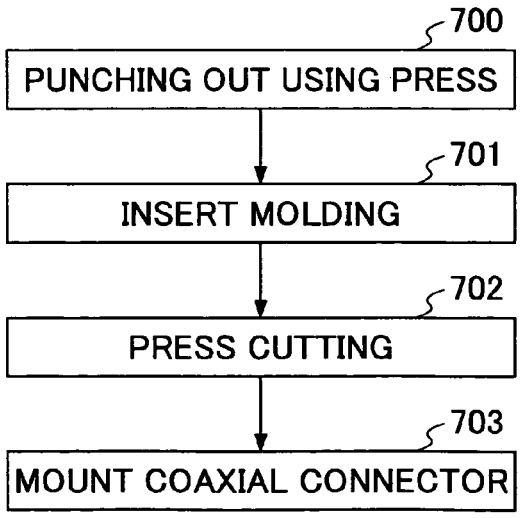
FIG. 18 is a diagram showing first steps for manufacturing the UWB flat antenna apparatus in FIG. 17.

As shown in FIG. 18, the UWB flat antenna apparatus 100C is manufactured through a step 700 of punching out using a press, a step 701 of insert molding, a step 702 of press cutting, and a step 703 of mounting a coaxial connector.

[Step 700 of Punching Out Using Press]

Figure 19:
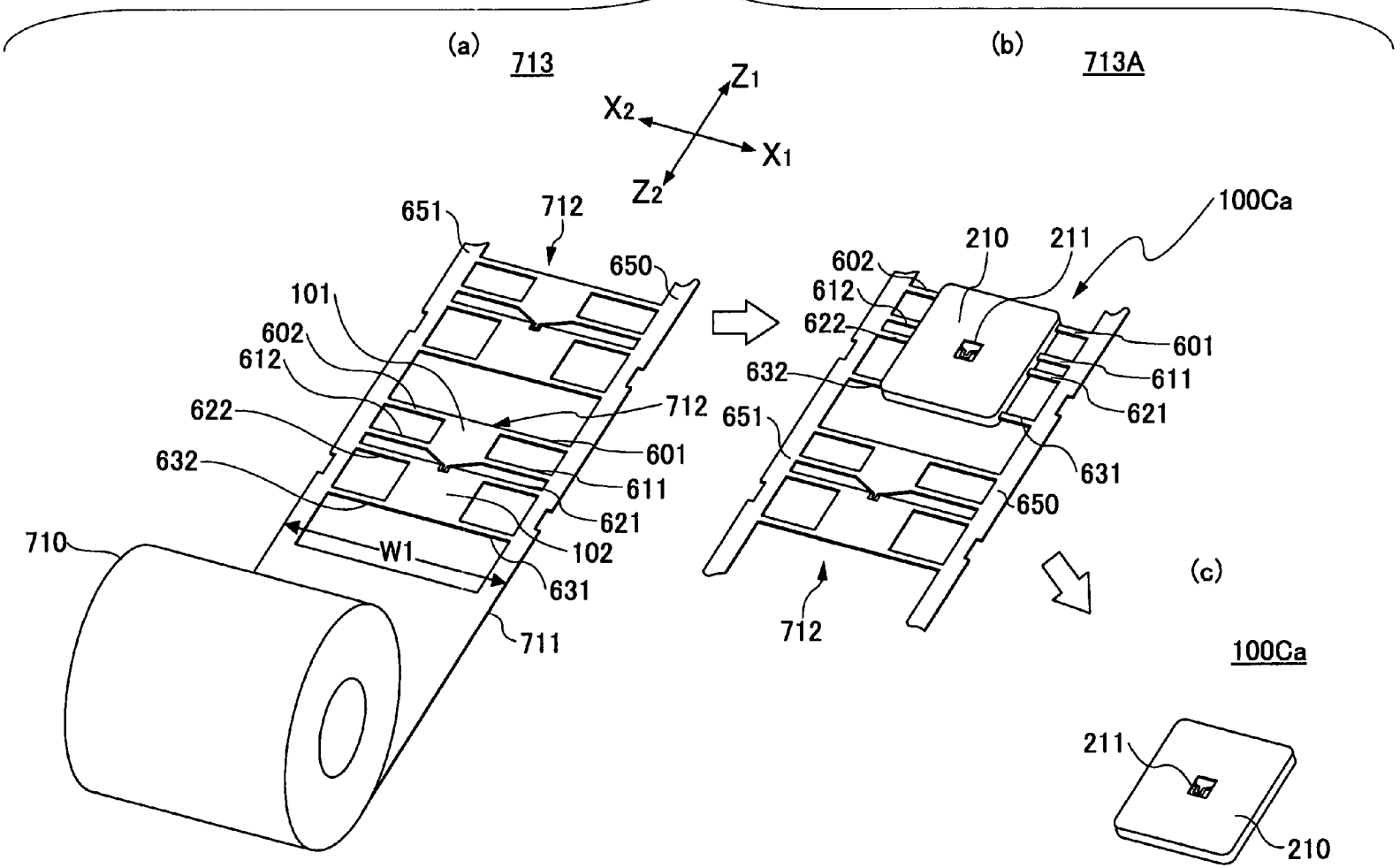
FIG. 19 is a diagram showing each step in FIG. 18.

As shown in FIG. 19-(*a*), a frame member 713 in which plural antenna bodies 712 are formed in a row is manufactured by punching out from a belt-like copper plate 711 in press working, the belt-like copper plate 711 having a width of W1 fed from a coiled body 710.

The antenna body 712 includes the antenna element 101, the ground element 102, frames 650 and 651, and the rungs 601, 602, 611, 612, 621, 622, 631, and 632. The antenna element 101 is supported by the rungs 601, 602, 611, and 612 between the frames 650 and 651. And the ground element 102 is supported by the rungs 621, 622, 631, and 632 between the frames 650 and 651. The positions of the antenna element 101 and the ground element 102 are the same as in the UWB flat antenna apparatus 100C.

In the frame member 713, a large number of antenna bodies 712 are arranged.

[Step 701 of Insert Molding]

Figure 20A:
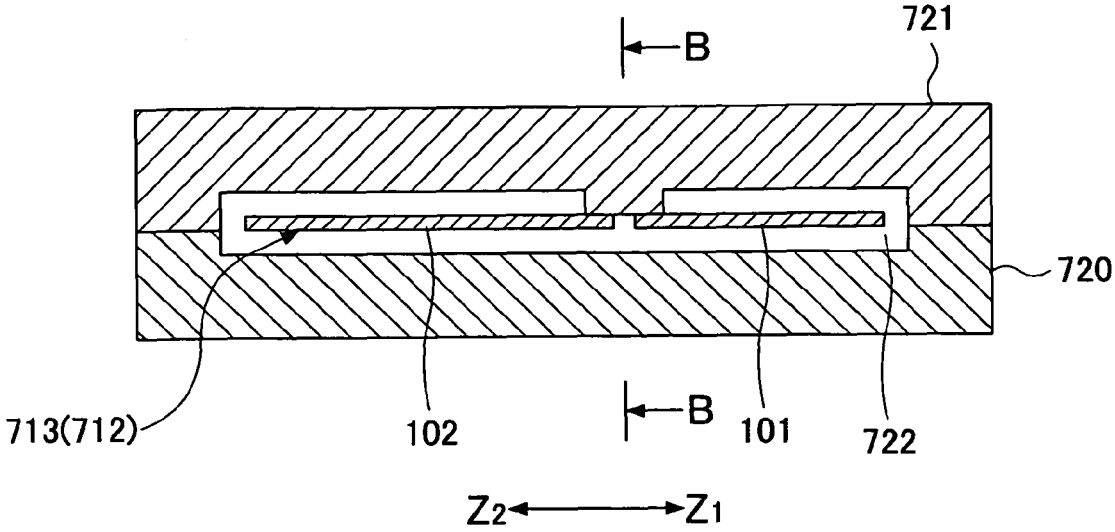
FIG. 20A is a diagram illustrating a step of insert molding.
Figure 20B:
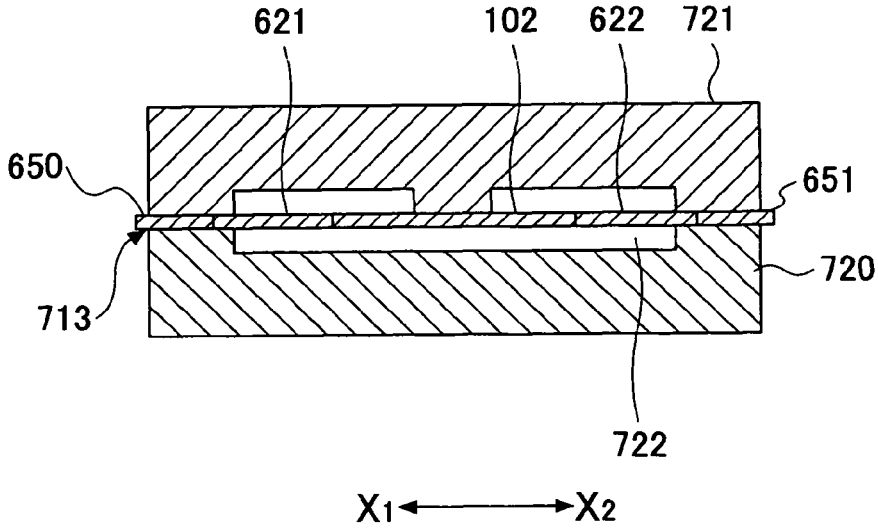
FIG. 20B is a cross-sectional view of the UWB flat antenna apparatus taken along line B-B in FIG. 20A.

As shown in FIGS. 20A and 20B, a single antenna body 712 from the frame member 713 is set between metal molds 720 and 721, and synthetic resin is injected into a cavity 722. The synthetic resin wraps the antenna element 101 and the ground element 102 except positions where the elements are brought close to each other and the synthetic resin portion 210 is formed by insert molding as shown in FIG. 19-(*b*). In accordance with this, the antenna body 712 is made to be a semifinished antenna apparatus 100Ca.

The rungs 601 and the like protrude from both side faces the synthetic resin portion 210. Further, the window portion 211 is formed on the top face 212 of the synthetic resin portion 210 and a portion of the antenna element 101 and a portion of the ground element 102 are positioned in an opposite manner in the window portion 211.

In accordance with this, the frame member 713 is made to be a frame member 713A with semifinished antenna apparatuses in which semifinished antenna apparatuses 100Ca are arranged.

[Step 702 of Press Cutting]

The frame member 713A with semifinished antenna apparatuses is set in a pressing machine and all the rungs 601 and the like are cut on the side faces of the synthetic resin portion 210, thereby separating the semifinished antenna apparatus 100Ca.

FIG. 19-(*c*) shows the separated semifinished antenna apparatus 100Ca.

[Step 703 of Mounting Coaxial Connector]

The socket-type coaxial connector 200 is mounted at the positions of the protrusion 101*a* and the concave portion 102*a* by fitting the socket-type coaxial connector 200 in the window portion 211 such that the socket-type coaxial connector 200 is disposed across the antenna element 101 and the ground element 102.

In accordance with this, the manufacture of the UWB flat antenna apparatus 100C shown in FIG. 17 is completed.

In this case, if positional accuracy of the antenna element 101 and the ground element 102 in the synthetic resin portion 210 is reduced, characteristics of the UWB flat antenna apparatus are deteriorated. However, in the present example, the antenna element 101 and the ground element 102 are each supported at two positions on an X1 side and an X2 side by the rungs 601 and the like between the frames 650 and 651. In accordance with this, when external force is applied from the synthetic resin injected upon insert molding, the relative position of the antenna element 101 and the ground element 102 is not likely to be changed. Thus, the positional accuracy of the antenna element 101 and the ground element 102 are preferably determined in the synthetic resin portion 210 and the UWB flat antenna apparatus 100C has desired characteristics.

In addition, the order of the step 702 of press cutting and the step 703 of mounting a coaxial connector may be reversed. In other words, the socket-type coaxial connector 200 may be mounted on each of the semifinished antenna apparatuses 100Ca in the frame member 713A with semifinished antenna apparatuses. Thereafter, the frame member 713A with semifinished antenna apparatuses may be set in the pressing machine and all the rungs 601 and the like may be cut on the side faces of the synthetic resin portion 210. In accordance with this, the UWB flat antenna apparatus 100C shown in FIG. 17 is separated and the manufacture thereof is completed.

(Second Manufacturing Method)

Figure 21:
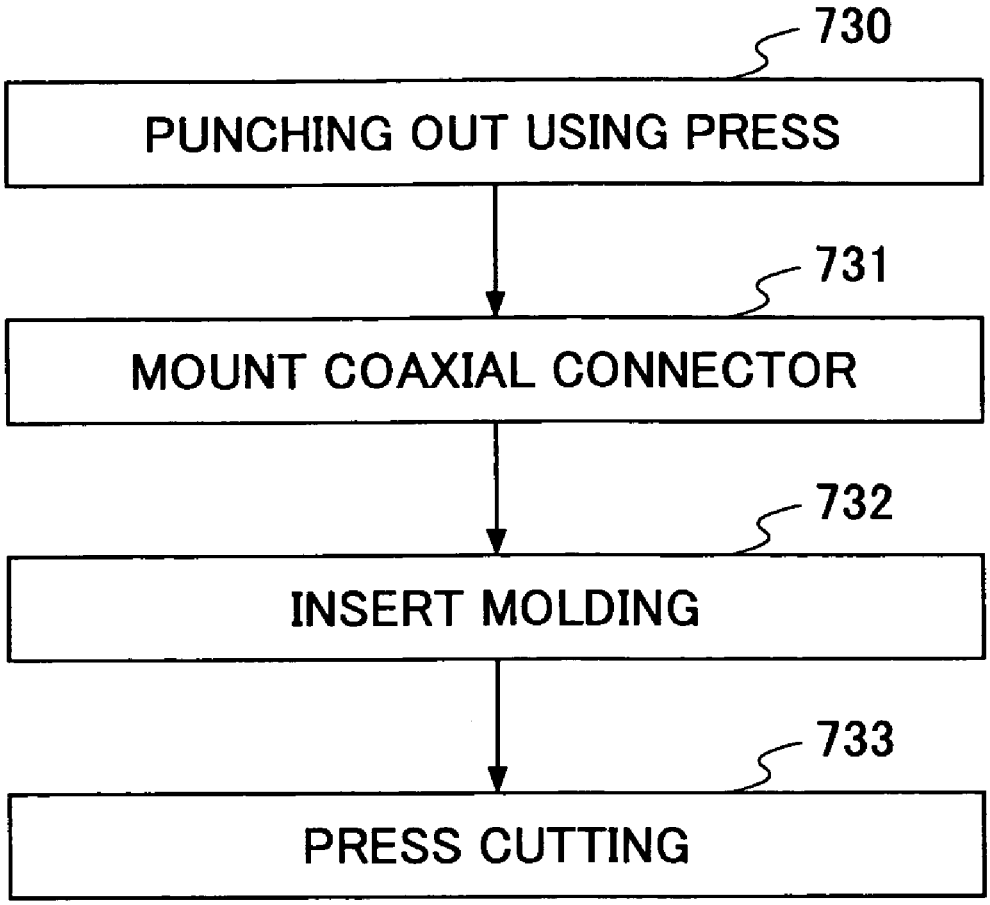
FIG. 21 is a diagram showing second steps for manufacturing the UWB flat antenna apparatus in FIG. 17.

As shown in FIG. 21, the UWB flat antenna apparatus 100C is manufactured through a step 730 of punching out using a press, a step 731 of mounting a coaxial connector, a step 732 of insert molding, and a step 733 of press cutting.

[Step 730 of Punching Out Using Press]

As shown in FIG. 19-(*a*), the frame member 713 in which plural antenna bodies 712 are formed in a row is manufactured by punching out from the copper plate 711 in press working.

[Step 731 of Mounting Coaxial Connector]

Figure 22:
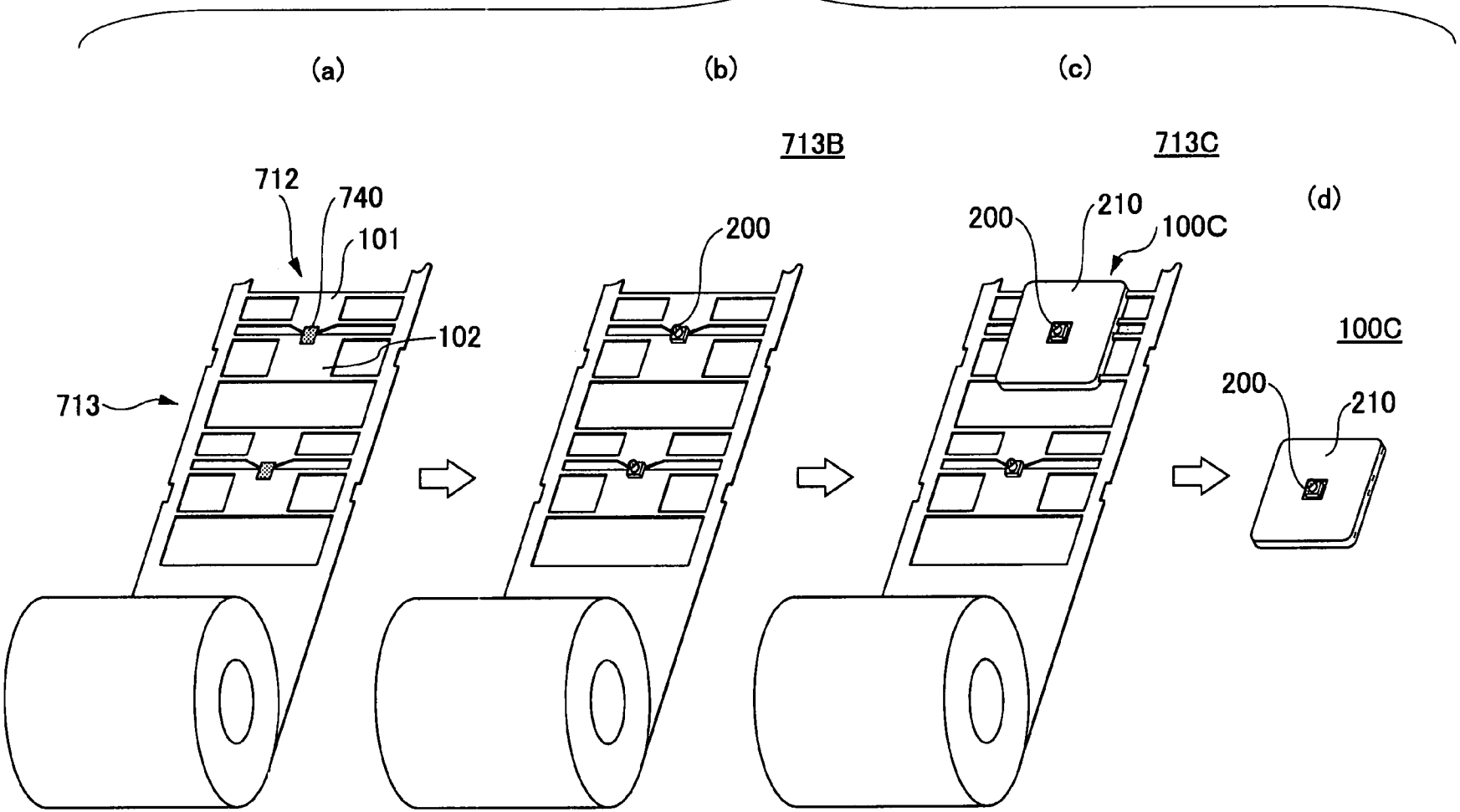
FIG. 22 is a diagram showing each step in FIG. 21.

First, as shown in FIG. 22-(*a*), the protrusion 101*a* and the concave portion 102*a* are coated with cream solder as shown in numeral 740 in each of the antenna bodies 712 of the frame member 713.

Next, the socket-type coaxial connector 200 is mounted at the positions of the protrusion 101*a* and the concave portion 102*a* such that the socket-type coaxial connector 200 is disposed across the antenna element 101 and the ground element 102. And the frame member 713 is passed through a reflow oven. In accordance with this, the socket-type coaxial connector 200 is mounted on each antenna body 712 as shown in FIG. 22-(*b*), and a frame member 713B with mounted socket-type coaxial connectors is manufactured.

[Step 732 of Insert Molding]

Figure 23:
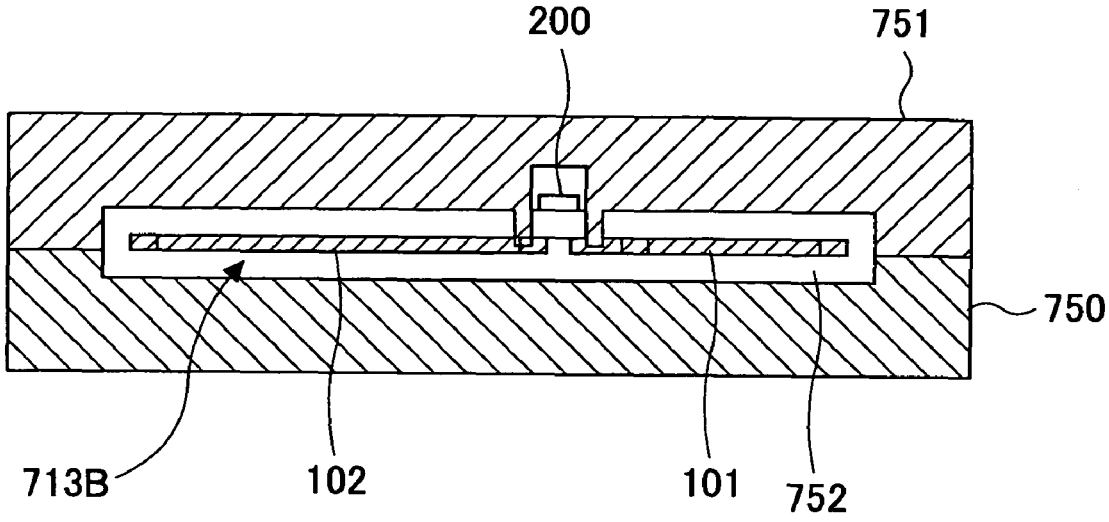
FIG. 23 is a diagram illustrating a step of insert molding.

As shown in FIG. 23, the frame member 713B with the mounted socket-type coaxial connector is set between metal molds 750 and 751, and synthetic resin is injected into a cavity 752. The synthetic resin wraps the antenna element 101 and the ground element 102 except a position of the mounted socket-type coaxial connector 200 and the synthetic resin portion 210 as shown in FIG. 17 is formed by insert molding.

In accordance with this, the frame member 713 is made to be a frame member 713C with completed antenna apparatuses in which completed antenna apparatuses are arranged as shown in FIG. 22-(*c*).

[Step 733 of Press Cutting]

The frame member 713C with completed antenna apparatuses is set in a pressing machine and all the rungs 601 and the like are cut on the side faces of the synthetic resin portion 210, thereby separating the antenna apparatus 100C as shown in FIG. 22-(*d*).

(Third Manufacturing Method)

Figure 24:
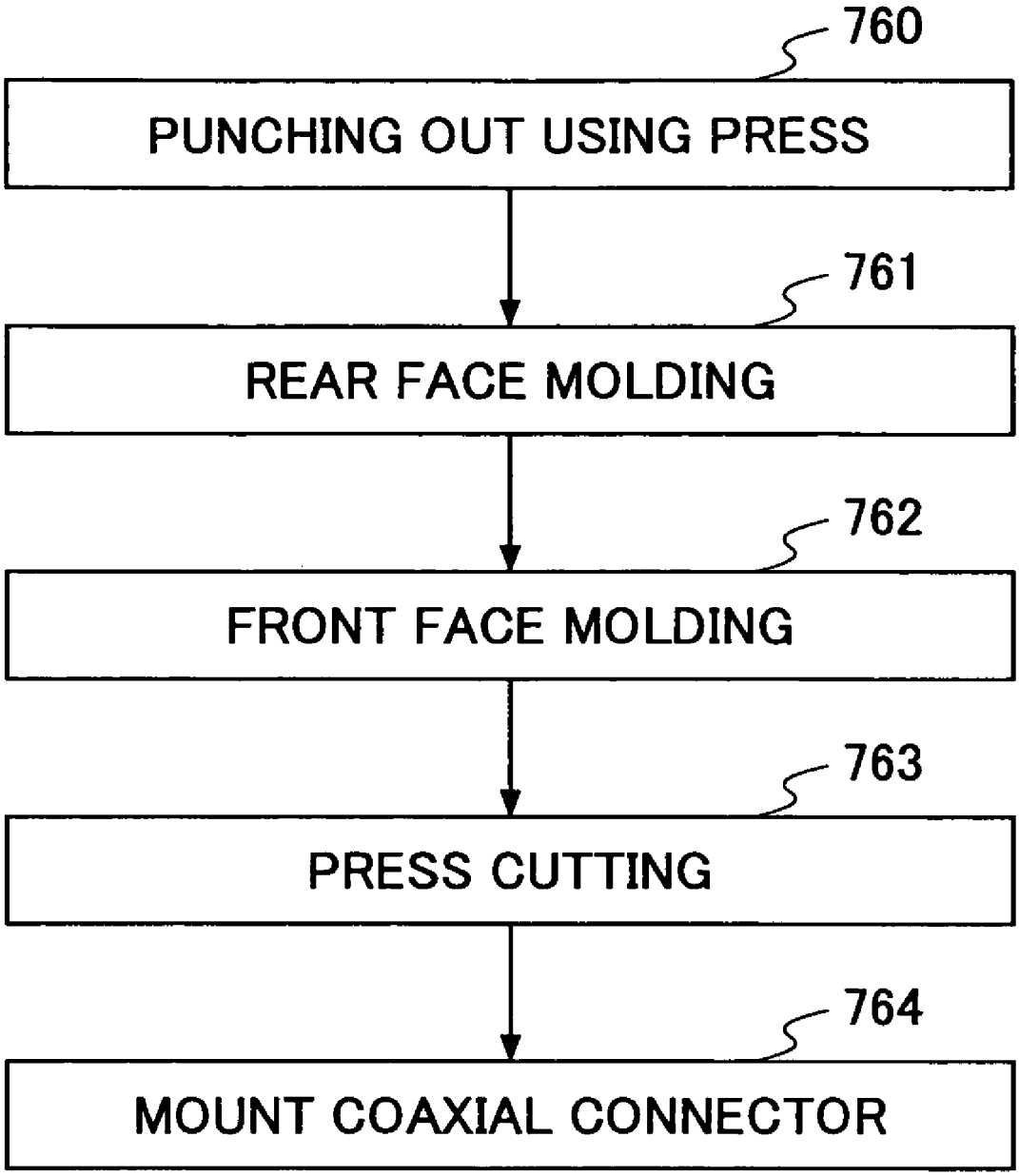
FIG. 24 is a diagram showing third steps for manufacturing the UWB flat antenna apparatus in FIG. 17.

In a third manufacturing method, the step 701 of insert molding in the first manufacturing method is divided in two steps. As shown in FIG. 24, the UWB flat antenna apparatus 100C is manufactured through a step 760 of punching out using a press, a step 761 of molding a rear face, a step 762 of molding a front face, a step 763 of press cutting, and a step 764 of mounting a coaxial connector.

[Step 760 of Punching Out Using Press]

Figure 25:
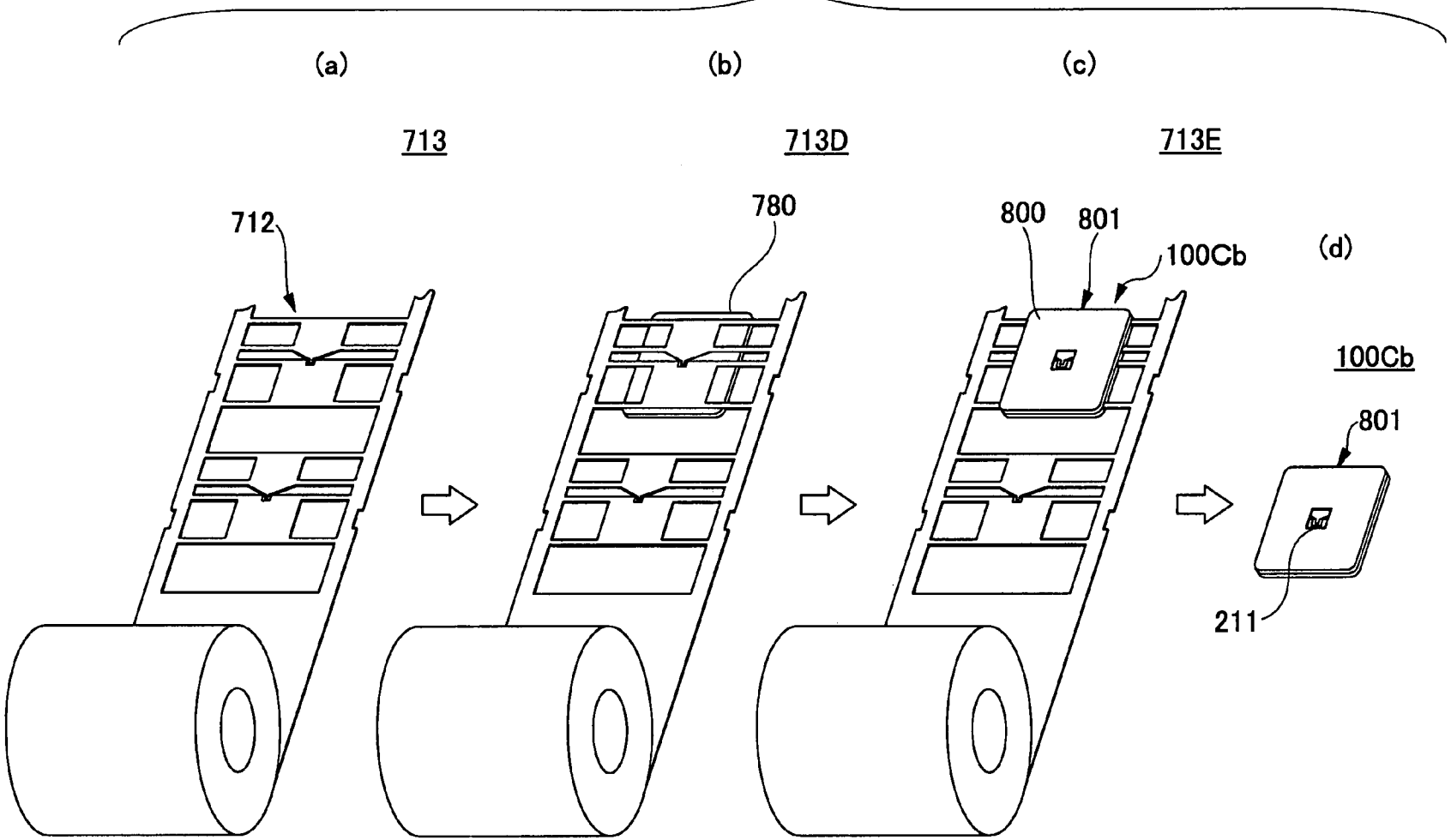
FIG. 25 is a diagram showing each step in FIG. 24.

As shown in FIGS. 25-(*a*) and 19-(*a*), the frame member 713 in which plural antenna bodies 712 are formed in a row is manufactured by punching out from the copper plate 711 in press working.

[Step 761 of Molding Rear Face]

Figure 26:
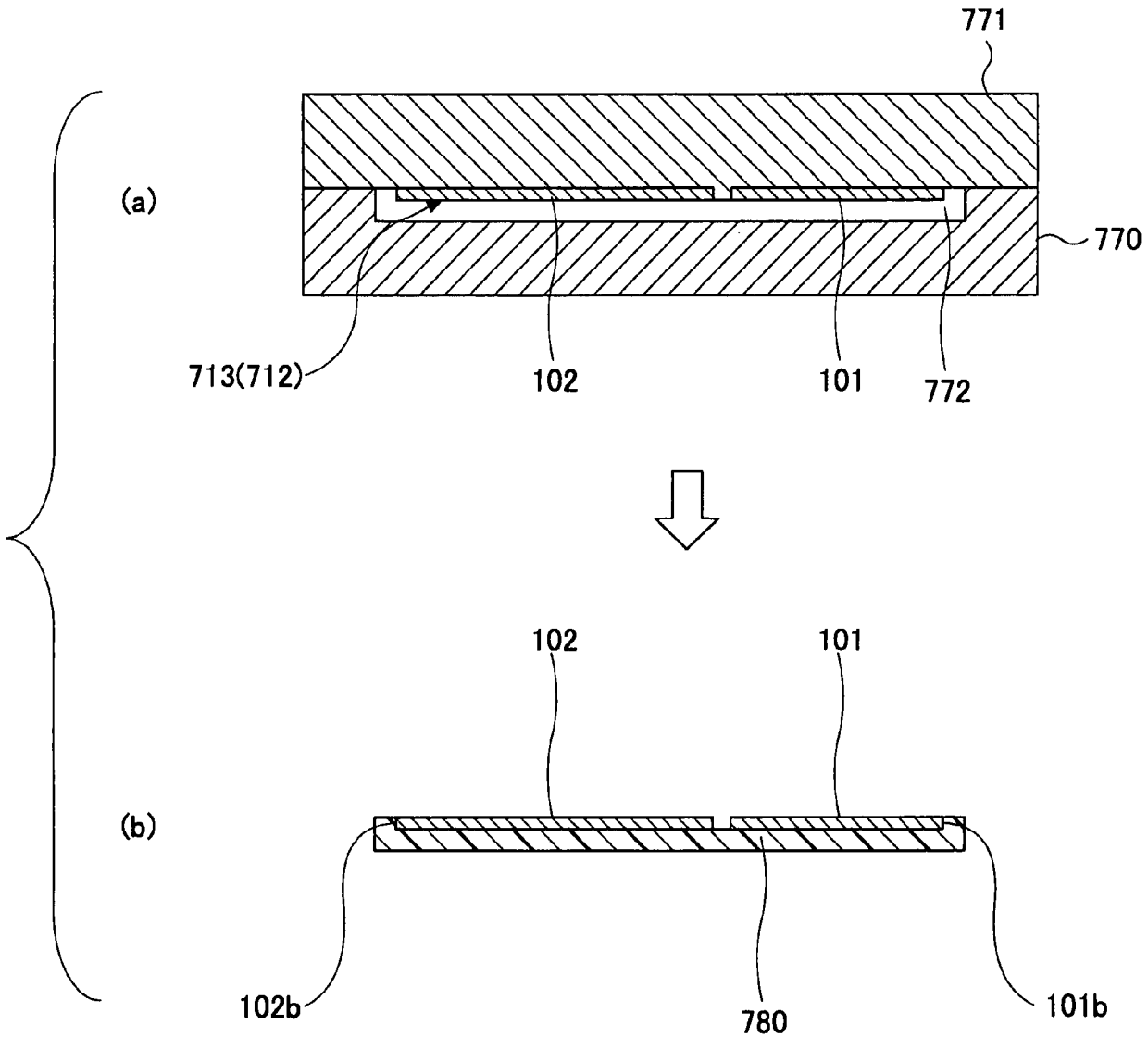
FIG. 26 is a diagram illustrating a step of molding a rear face.

As shown in FIG. 26-(*a*), the frame member 713 is set between metal molds 770 and 771 and synthetic resin is injected into a cavity 772. The synthetic resin covers rear faces of the antenna element 101 and ground element 102 and a plate-like rear face synthetic resin portion 780 is molded as shown in FIG. 26-(*b*). In accordance with this, a frame member 713D with a rear face synthetic resin portion shown in FIG. 25-(*b*) is manufactured.

As shown in FIG. 26-(*b*), the rear face synthetic resin portion 780 also covers an end face 101*b* of the antenna element 101 and an end face 102*b* of the ground element 102, and the antenna element 101 and the ground element 102 are integrated with the rear face synthetic resin portion 780.

In this case, when the frame member 713 is set between the metal molds 770 and 771, entire areas of the antenna element 101 and the ground element 102 are positioned at an undersurface of the metal mold 770. In accordance with this, when the synthetic resin is injected into the cavity 772, the antenna element 101 and the ground element 102 are stably held without causing positional displacement.

[Step 762 of Molding Front Face]

Figure 27:
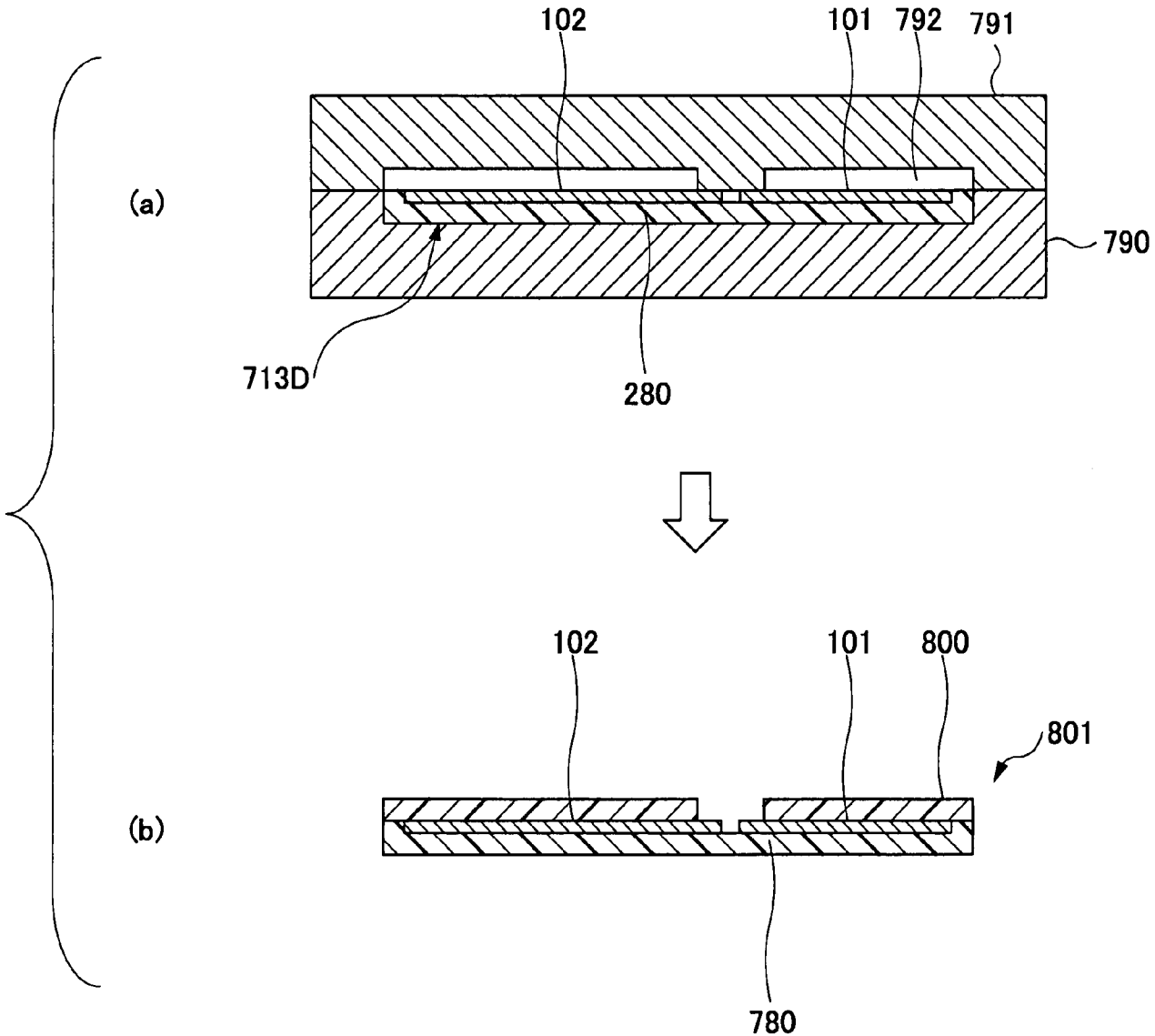
FIG. 27 is a diagram illustrating a step of molding a front face.

As shown in FIG. 27-(*a*), the frame member 713D with a rear face synthetic resin portion is set between metal molds 790 and 791 and synthetic resin is injected into a cavity 792. As shown in FIG. 27-(*b*), the synthetic resin covers top faces of the antenna element 101 and the ground element 102 except a position on which a coaxial connector is to be mounted, and a plate-like front face synthetic resin portion 800 is molded. A plate-like synthetic resin portion 801 is prepared by integrating the front face synthetic resin portion 800 with the rear face synthetic resin portion 780. The synthetic resin portion 801 covers the top faces and rear faces of the antenna element 101 and the ground element 102 except the position on which the coaxial connector is to be mounted. In addition, the synthetic resin portion 801 has no pin hole generated by pulling out a pin as will be described in the following.

The frame member 713D with a rear face synthetic resin portion is made to be the frame member 713A with semifinished antenna apparatuses in which semifinished antenna apparatuses 100Cb are arranged.

[Step 763 of Press Cutting]

The frame member 713A with semifinished antenna apparatuses is set in a pressing machine and all the rungs 601 and the like are cut on side faces of the synthetic resin portion 801, thereby separating the semifinished antenna apparatus 100Cb. FIG. 25-(*d*) shows the semifinished antenna apparatus 100Cb obtained as a result of the separation.

[Step 764 of Mounting Coaxial Connector]

The socket-type coaxial connector 200 is mounted at the positions of the protrusion 101*a* and the concave portion 102*a* by fitting the socket-type coaxial connector 200 in the window portion 211 such that the socket-type coaxial connector 200 is disposed across the antenna element 101 and the ground element 102.

In accordance with this, the manufacture of the UWB flat antenna apparatus 100C shown in FIG. 17 is completed.

In this case, in the above-mentioned first or second manufacturing method, namely, in the insert molding for wrapping the antenna element 101 and the ground element 102 in a single molding, positions of the antenna element 101 and the ground element 102 may be displaced upon insert molding. Thus, the positions of the antenna element 101 and the ground element 102 are generally fixed by disposing plural pressure pins on the metal molds in a protruding manner and holding the antenna element 101 and the ground element 102 using the pressure pins. Thus, upon manufacturing in the first or second manufacturing method, pin holes are left on the plate-like synthetic resin portion wrapping the antenna element 101 and the ground element 102 and the pin holes are exposed to the outside. This is not preferable when the UWB flat antenna apparatus is embedded in an electronic device so as to be seen in appearance thereof.

However, according to the third example, the pressure pins are not necessary for the metal molds and no pin holes are left on the synthetic resin portion 801, so that it is possible to embed the UWB flat antenna apparatus in an electronic device at such positions that are seen in appearance without the above-mentioned problem.

EXAMPLE 5

Figure 28A:
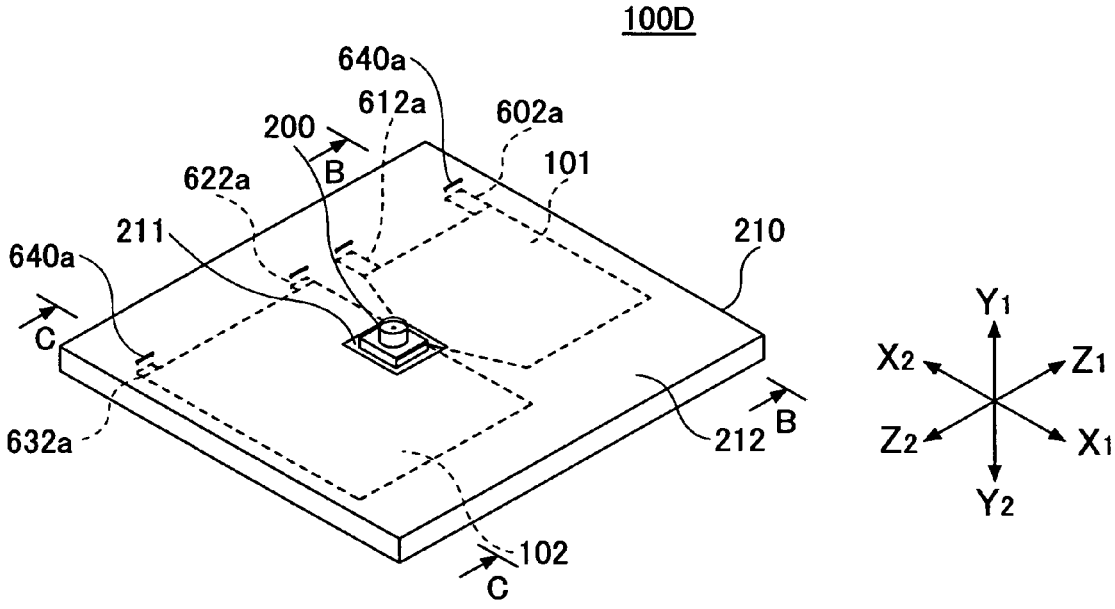
FIG. 28A is a perspective view showing a UWB flat antenna apparatus according to example 5 of the present invention.
Figure 28B:
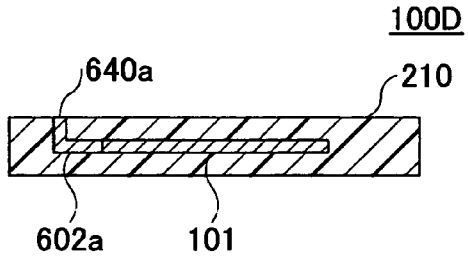
FIG. 28B is a cross-sectional view of the UWB flat antenna apparatus taken along line B-B in FIG. 28A.
Figure 28C:
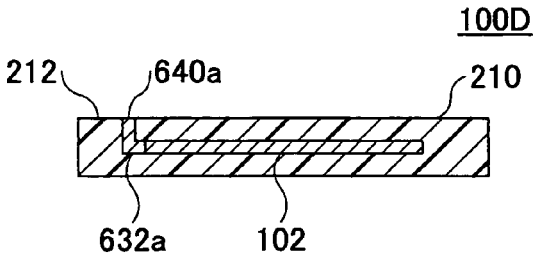
FIG. 28C is a cross-sectional view of the UWB flat antenna apparatus taken along line C-C in FIG. 28A.

FIGS. 28A to 28C show a UWB flat antenna apparatus 100D according to example 5 of the present invention.

The UWB flat antenna apparatus 100D is different in rungs from the UWB flat antenna apparatus 100C shown in FIG. 17.

The UWB flat antenna apparatus 100D has no rungs extending in the X1 direction from the antenna element 101 and the ground element 102.

Rungs 602*a*, 612*a*, 622*a*, and 632*a* extending in the X2 direction from the antenna element 101 and the ground element 102 are extremely short and bent in the Y1 direction. Further, ends 640*a* thereof are exposed on the top face 212 of the synthetic resin portion 210.

In accordance with this, the UWB flat antenna apparatus 100D experiences no degradation of antenna characteristics resulting from the rungs and has preferable characteristics in comparison with the UWB flat antenna apparatus 100C shown in FIG. 17.

Figure 29:
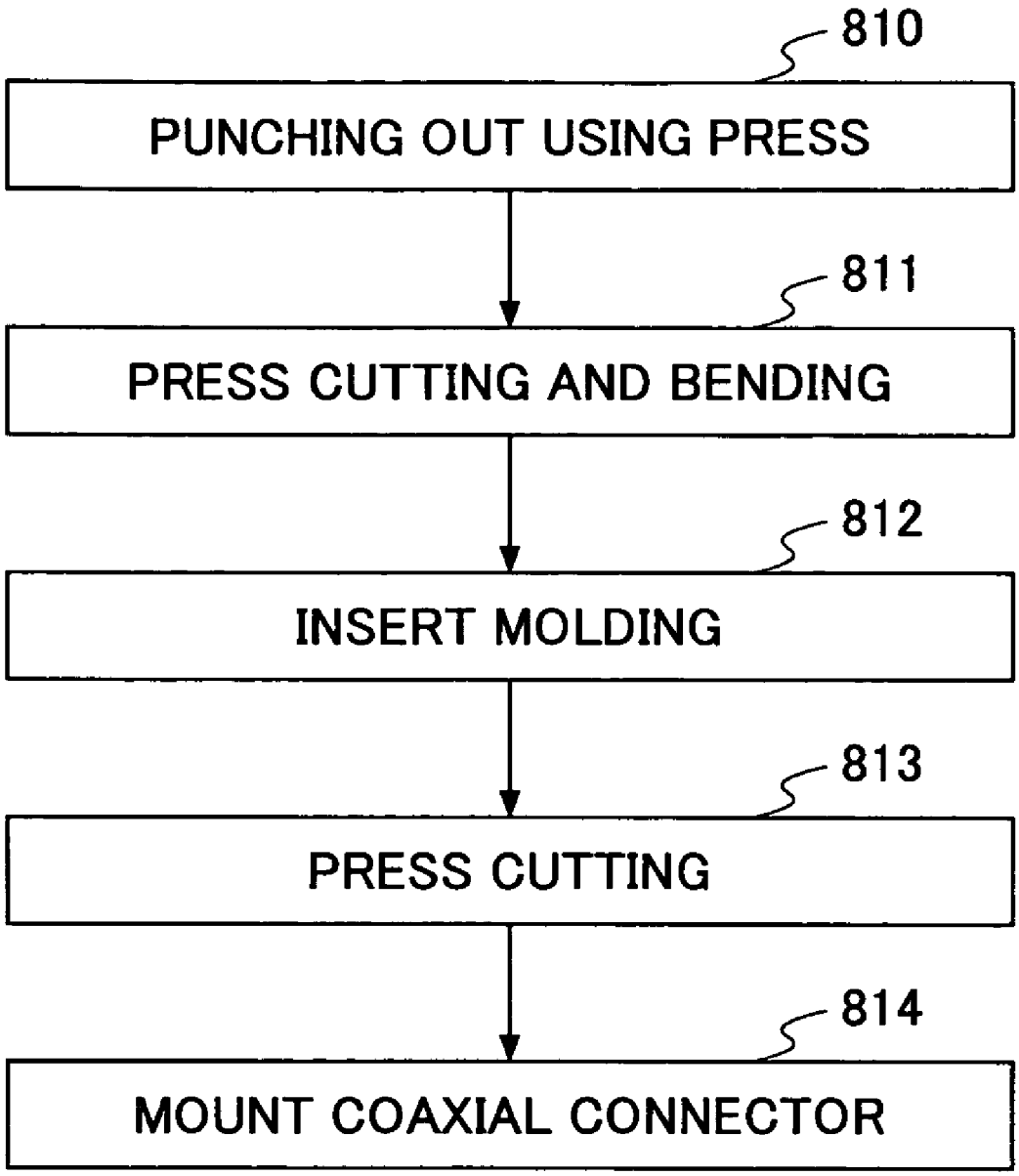
FIG. 29 is a diagram showing steps for manufacturing the UWB flat antenna apparatus in FIG. 28A.

As shown in FIG. 29, the UWB flat antenna apparatus 100D is manufactured through a step 810 of punching out using a press, a step 811 of press cutting and bending, a step 812 of insert molding, a step 813 of press cutting, and a step 814 of mounting a coaxial connector.

[Step 810 of Punching Out Using Press]

Figure 30:
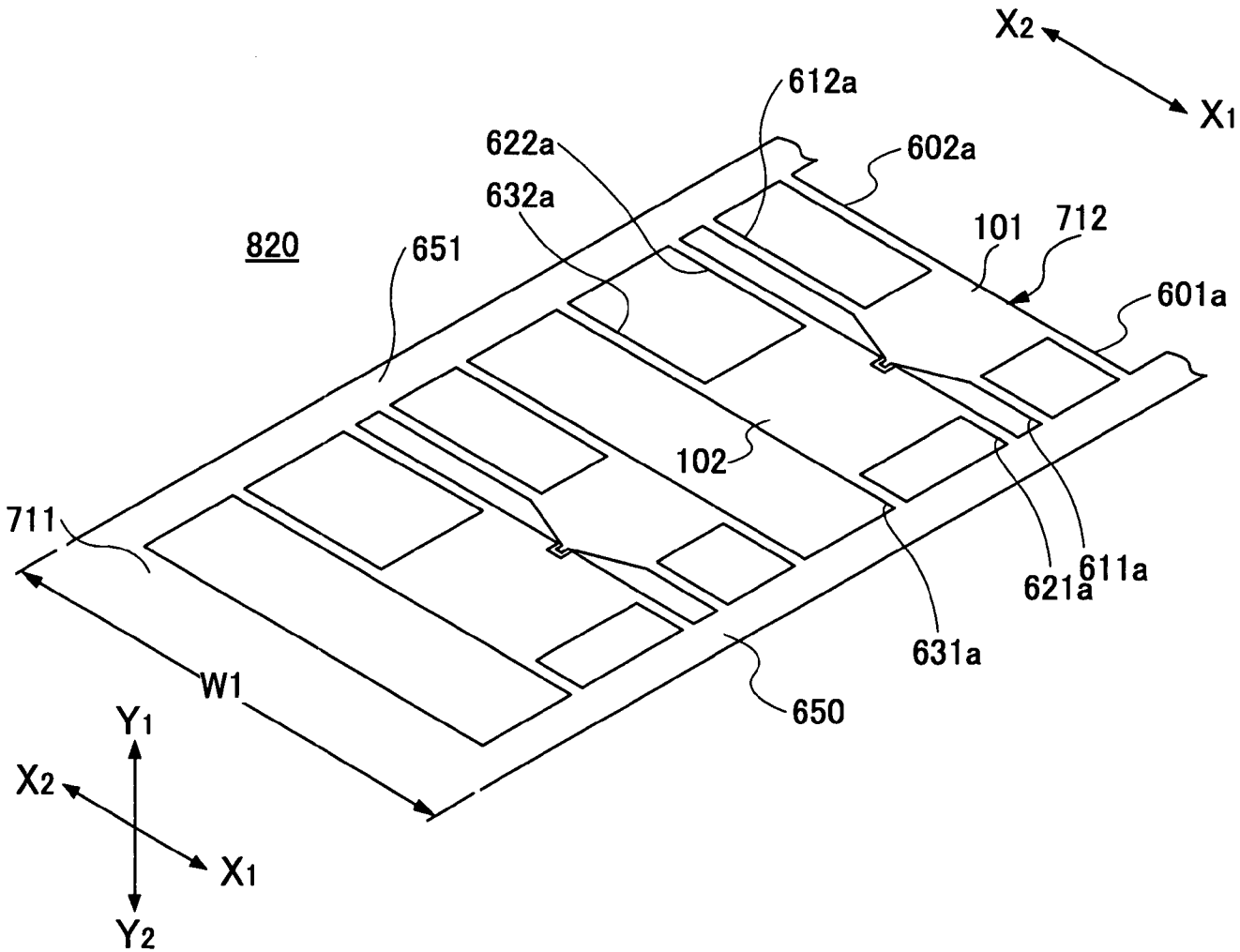
FIG. 30 is a diagram showing when a step of press punching in FIG. 29 is completed.

As shown in FIG. 30, a frame member 820 in which plural antenna bodies 712 are formed in a row is manufactured by punching out from the belt-like copper plate 711 having a width of W1 in press working.

The antenna body 712 includes the antenna element 101 and the ground element 102.

Differing from the frame member 713 shown in FIG. 19-(*a*), the antenna element 101 and the ground element 102 are positioned on the X1 side relative to a center thereof.

[Step 811 of Press Cutting and Bending]

Figure 31A:
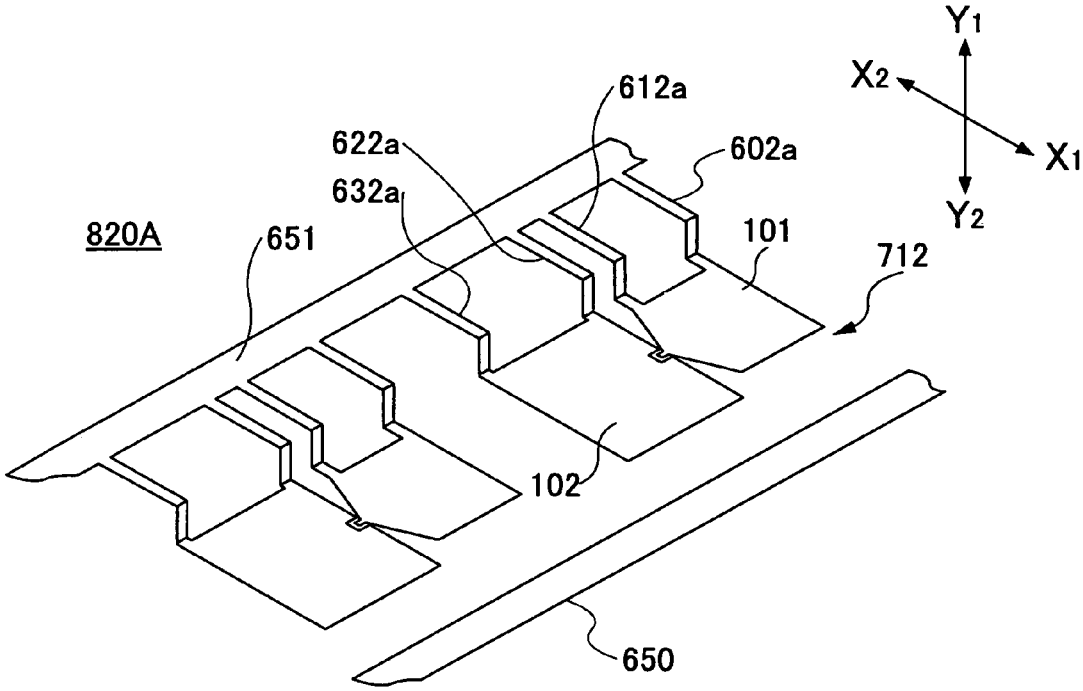
FIG. 31A is a diagram showing when a step of press cutting and bending in FIG. 29 is completed.

The frame member 820 is set in a pressing machine and the rungs 601*a* and the like on the X1 side are cut and removed. The rungs 602*a* and the like on the X2 side are cranked in the Y2 direction In accordance with this, the frame member 820 is made to be a processed frame member 820A as shown in FIG. 31A. The antenna body 712 is positioned on the Y2 side relative to the frames 650 and 651.

[Step 812 of Insert Molding]

Figure 31B:
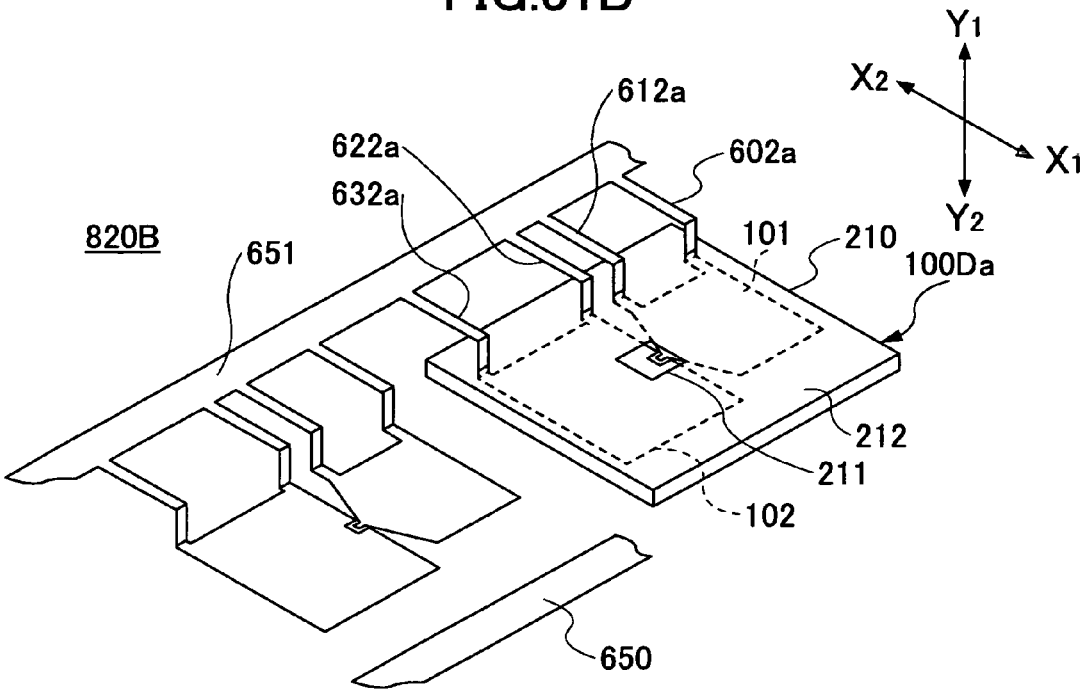
FIG. 31B is a diagram showing when a step of insert molding in FIG. 29 is completed.

The antenna body 712 of the processed frame member 820A is set between metal molds and synthetic resin is injected into a cavity. In accordance with this, as shown in FIG. 31B, the plate-like synthetic resin portion 210 is formed by insert molding. The rungs 602*a* and the like protrude from the top face 212 of the plate-like synthetic resin portion 210.

The processed frame member 820A is made to be a frame member 820B with semifinished antenna apparatuses in which semifinished antenna apparatuses 100Da are formed in a row.

[Step 813 of Press Cutting]

The frame member 820B with semifinished antenna apparatuses is set in a pressing machine and all the rungs 602*a* and the like are cut on the top face of the synthetic resin portion 210, thereby separating the semifinished antenna apparatuses 100Da.

[Step 814 of Mounting Coaxial Connector]

The socket-type coaxial connector 200 is fitted in the window portion 211 and mounted.

In accordance with this, the manufacture of the UWB flat antenna apparatus 100D shown in FIG. 28 is completed.

EXAMPLE 6

Figure 32:
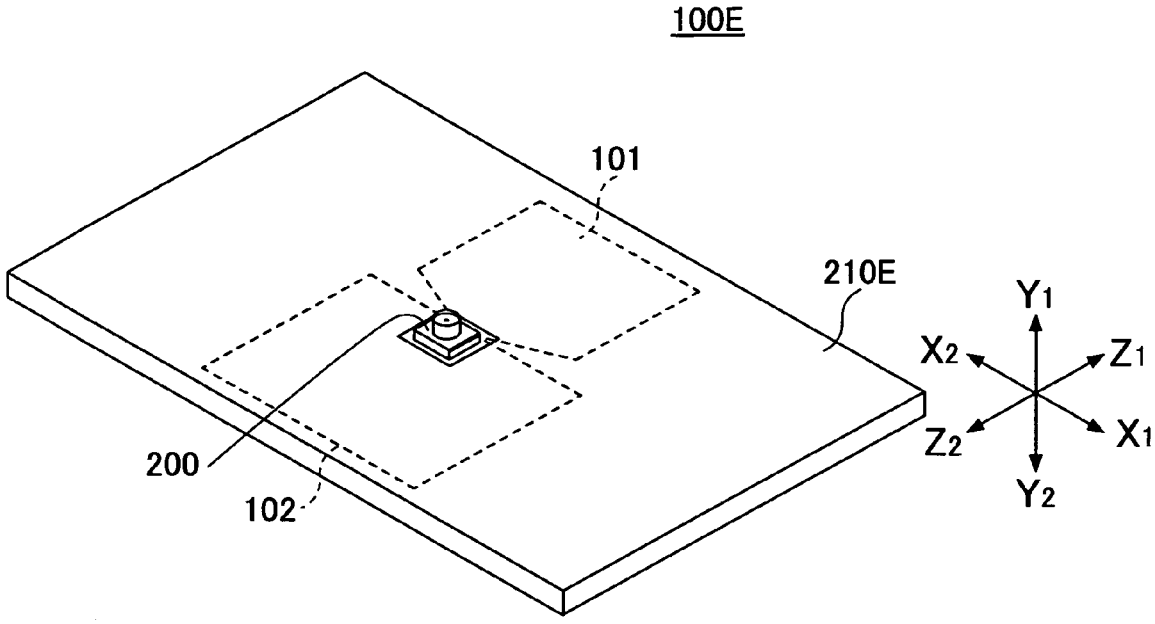
FIG. 32 is a perspective view showing a UWB flat antenna apparatus according to example 6 of the present invention.

FIG. 32 shows a UWB flat antenna apparatus 100E according to example 6 of the present invention.

The UWB flat antenna apparatus 100E is different from the UWB flat antenna apparatus 100D shown in FIG. 28 in that a length of a synthetic resin portion 210E is longer in the X1-X2 direction. The UWB flat antenna apparatus 100E is applied to an electronic device when there is a wide area for a location on which the UWB flat antenna apparatus is disposed.

The UWB flat antenna apparatus 100E is also manufactured using the belt-like copper plate 711 having the width of W1 as shown in FIG. 30 instead of using a belt-like copper plate having a wide width. Thus, although a size of the UWB flat antenna apparatus 100E is large, manufacturing costs thereof are not increased.

In other words, first, the frame member 820 shown in FIG. 30 is manufactured. Then, as shown in FIG. 31A, the processed frame member 820A in which the antenna body 712 is positioned on the Y2 side relative to the frames 650 and 651 is manufactured by cutting and removing or cranking the rungs.

Figure 33:
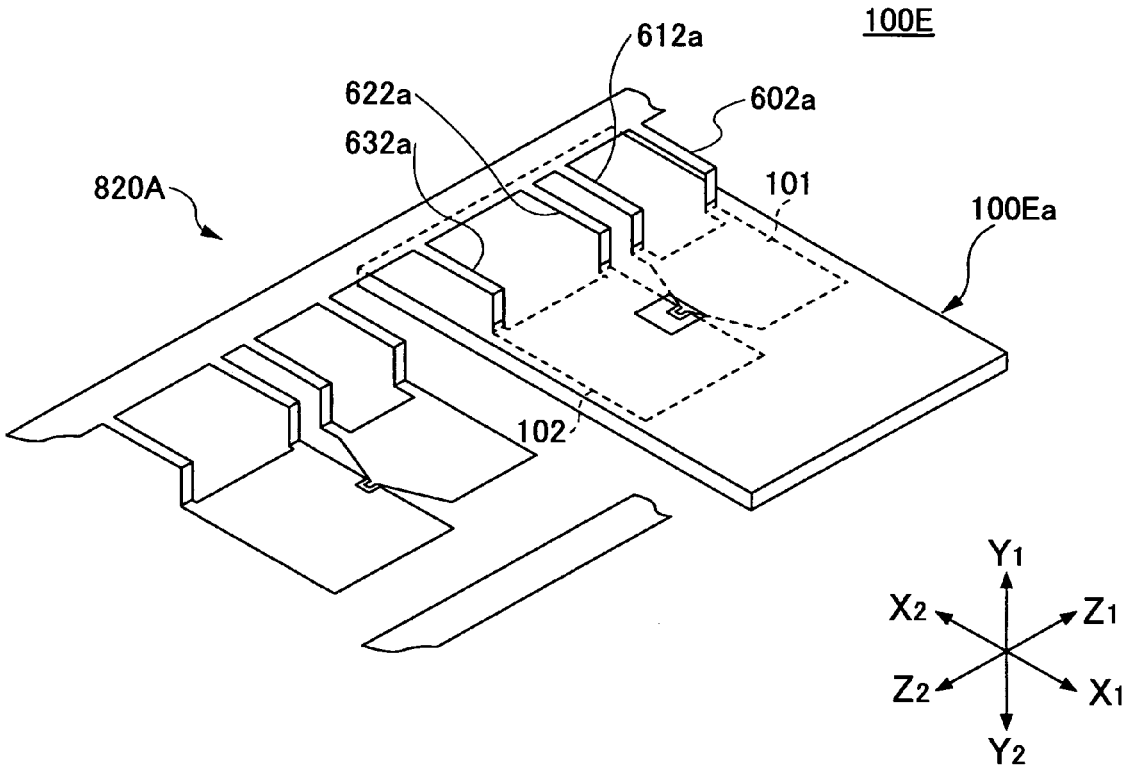
FIG. 33 is a diagram showing when a step of insert molding is completed.

Next, the antenna body 712 of the processed frame member 820A is set between metal molds and synthetic resin such as ABS is injected into a cavity, thereby forming the plate-like synthetic resin portion 210E by insert molding as shown in FIG. 33.

Thereafter, through a step 803 of press cutting and a step 804 of mounting a coaxial connector in the same manner as mentioned above, the manufacture of the UWB flat antenna apparatus 100E as shown in FIG. 32 is completed.

The present invention is not limited to the specifically disclosed embodiment, and variations and modifications may be made without departing from the scope of the present invention.

The present application is based on Japanese priority application No. 2006-094429 filed Mar. 30, 2006 and Japanese priority application No. 2006-242016 filed Sep. 6, 2006, the entire contents of which are hereby incorporated herein by reference.

What is claimed is:

1. An antenna apparatus, comprising:

a punched out antenna element made of sheet metal;

a punched out ground element made of sheet metal, the ground element being coplanar with, and spaced by a gap from, the antenna element, wherein two sides of the antenna element opposing a side of the ground element are each tilted by a non-zero angle with respect to an axis orthogonal to the side of the ground element; and a surface mount type coaxial connector positioned to extend across the gap and interconnect the antenna element and the ground element.

2. An antenna apparatus comprising:

a punched out antenna element made of sheet metal;

a punched out ground element made of sheet metal, coplanar with and spaced by a gap from the antenna element;

a surface mount type coaxial connector positioned to extend across the gap and interconnect the antenna element and the ground element; and a plate-like synthetic resin portion molded onto and encasing the antenna element and the ground element, except for the coaxial connector, and fixing the antenna element and the ground element together.

3. An antenna apparatus, comprising:

a punched out antenna element made of sheet metal;

a punched out ground element made of sheet metal, coplanar with and spaced by a gap from, the antenna element;

a surface mount type coaxial connector positioned to extend across the gap and interconnect the antenna element and the ground element; and a plate-like synthetic resin portion molded onto and encasing the antenna element and the ground element and having an internal recess into which the coaxial connector extends, the synthetic resin portion fixing the antenna element and the ground element together.

* * * * *